US010576537B2

(12) United States Patent
Bullied et al.

(10) Patent No.: US 10,576,537 B2
(45) **Date of Patent: *Mar. 3, 2020**

(54) MULTI-SHOT CASTING

(71) Applicant: United Technologies Corporation, Farmington, CT (US)

(72) Inventors: Steven J. Bullied, Pomfret Center, CT (US); Dilip M. Shah, Glastonbury, CT (US); Alan D. Cetel, West Hartford, CT (US); John J. Marcin, Jr., Marlborough, CT (US)

(73) Assignee: United Technologies Corporation, Farmington, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/267,900

(22) Filed: Feb. 5, 2019

(65) Prior Publication Data

US 2019/0168296 A1 Jun. 6, 2019

Related U.S. Application Data

(62) Division of application No. 15/605,087, filed on May 25, 2017, now Pat. No. 10,456,830, which is a (Continued)

(51) Int. Cl.

| | |
|---|---|
| ***B22D 19/16*** | (2006.01) |
| ***F01D 5/14*** | (2006.01) |
| ***B22D 27/04*** | (2006.01) |

(52) U.S. Cl.

CPC ..... *B22D 19/16* (2013.01); *B22D 27/045* (2013.01); *F01D 5/147* (2013.01); *F05D 2230/211* (2013.01)

(58) Field of Classification Search

CPC ..... B22D 19/16; B22D 27/045

See application file for complete search history.

(56) References Cited

U.S. PATENT DOCUMENTS

| | | | |
|---|---|---|---|
| 1,361,188 | A | 12/1920 | Schmidt |
| 2,479,039 | A | 8/1949 | Cronstedt |

(Continued)

FOREIGN PATENT DOCUMENTS

| | | | |
|---|---|---|---|
| EP | 2092997 | A1 | 8/2009 |
| EP | 2233229 | A1 | 9/2010 |

(Continued)

OTHER PUBLICATIONS

Partial European Search Report dated Feb. 1, 2019 for European Patent Application No. 18206746.2.

(Continued)

*Primary Examiner* — Kevin P Kerns
*Assistant Examiner* — Steven S Ha
(74) *Attorney, Agent, or Firm* — Bachman & LaPointe, P.C.

(57) ABSTRACT

A casting mold has a pour cone, a downsprue, and a part-forming cavity having a lower end and an upper end. The downsprue extends from the pour cone toward the part-forming cavity and has: a lower portion having a plurality of ports in communication with the part-forming cavity; and an upper portion telescoping relative to the lower portion and coupling the lower portion to the pour cone.

16 Claims, 19 Drawing Sheets

Related U.S. Application Data division of application No. 14/651,926, filed as application No. PCT/US2013/075017 on Dec. 13, 2013, now Pat. No. 9,687,910.

(60) Provisional application No. 61/794,519, filed on Mar. 15, 2013, provisional application No. 61/737,530, filed on Dec. 14, 2012.

(56) References Cited

U.S. PATENT DOCUMENTS

| | | | |
|---|---|---|---|
| 3,847,203 | A | 11/1974 | Northwood |
| 4,008,052 | A | 2/1977 | Vishnevsky et al. |
| 4,869,645 | A | 9/1989 | Verpoort |
| 5,000,244 | A | 3/1991 | Osborne |
| 5,035,958 | A | 7/1991 | Jackson et al. |
| 5,100,484 | A | 3/1992 | Wukusick et al. |
| 5,335,711 | A | 8/1994 | Paine |
| 5,409,781 | A | 4/1995 | Roster et al. |
| 5,451,142 | A | 9/1995 | Cetel et al. |
| 5,558,150 | A | 9/1996 | Sponseller |
| 6,074,602 | A | 6/2000 | Wukusick et al. |
| 6,419,763 | B1 | 7/2002 | Konter et al. |
| 7,037,079 | B2 | 5/2006 | Wettstein et al. |
| 7,065,872 | B2 | 6/2006 | Ganesh et al. |
| 7,231,955 | B1 | 6/2007 | Bullied et al. |
| 7,546,685 | B2 | 6/2009 | Ganesh et al. |
| 7,757,748 | B2 | 7/2010 | Shiraki et al. |
| 7,762,309 | B2 | 7/2010 | Tamaddoni-Jahromi et al. |
| 7,967,570 | B2 | 6/2011 | Shi et al. |
| 8,387,678 | B1 * | 3/2013 | Park ..... B22D 37/00 164/133 |
| 10,456,830 | B2 * | 10/2019 | Bullied ..... F01D 5/147 |
| 2005/0016710 | A1 | 1/2005 | Malterer |
| 2005/0271886 | A1 | 12/2005 | Cetel |
| 2007/0240845 | A1 | 10/2007 | Graham et al. |
| 2008/0237403 | A1 | 10/2008 | Kelly et al. |
| 2009/0078390 | A1 | 3/2009 | Tamaddoni-Jahromi et al. |
| 2009/0133850 | A1 | 5/2009 | Kelly et al. |
| 2009/0165988 | A1 | 7/2009 | Rockstroh et al. |
| 2010/0297467 | A1 | 11/2010 | Sawtell et al. |
| 2010/0329921 | A1 | 12/2010 | Miller et al. |
| 2011/0123386 | A1 | 5/2011 | Mitchell et al. |
| 2011/0158887 | A1 | 6/2011 | Stoddard et al. |
| 2011/0293431 | A1 | 12/2011 | Harders et al. |

FOREIGN PATENT DOCUMENTS

| | | | |
|---|---|---|---|
| GB | 2003421 | A | 3/1979 |
| JP | 5641047 | A | 4/1981 |
| JP | 03189065 | A | 8/1991 |
| JP | 05237636 | A | 9/1993 |
| JP | 2011137220 | A | 7/2011 |
| JP | 2012532250 | A | 12/2012 |
| WO | 2014093826 | A2 | 6/2014 |
| WO | 2014133635 | A2 | 9/2014 |

OTHER PUBLICATIONS

Extended European Search Report dated Jul. 11, 2019 for European Patent Application No. 18206746.2.

U.S. Office Action dated Apr. 1, 2019 for U.S. Appl. No. 15/605,087.

International Search Report and Written Opinion for PCT/US2013/075017, dated Sep. 24, 2014.

International Search Report and Written Opinion for PCT/US2013/074956, dated Sep. 24, 2014.

Singapore Office Action for Application No. 11201503471R, dated Mar. 8, 2016.

European Search Report for EP Patent Application No. 13862454.9, dated Jun. 7, 2016.

* cited by examiner

MULTI-SHOT CASTING

CROSS-REFERENCE TO RELATED APPLICATIONS

This is a divisional application of U.S. patent application Ser. No. 15/605,087, filed May 25, 2017, and entitled "Multi-Shot Casting" ("the '087 Application") which is a divisional application of U.S. patent application Ser. No. 14/651,926, filed Jun. 12, 2015, and entitled "Multi-Shot Casting" ("the '926 Application" now U.S. Pat. No. 9,687,910, issued Jun. 27, 2017) which is the 35 U.S.C. 371 National Stage of PCT/US2013/075017, filed Dec. 13, 2013, and benefit is claimed of U.S. Patent Application No. 61/737,530, filed Dec. 14, 2012, and entitled "Hybrid Turbine Blade for Improved Engine Performance or Architecture" ("the '530 Application") and U.S. Patent Application No. 61/794,519, filed Mar. 15, 2013, and entitled "Multi-Shot Casting" ("the '519 Application"), the disclosures of which applications are incorporated by reference herein in their entirety as if set forth at length.

BACKGROUND

The disclosure relates to casting of aerospace components. More particularly, the disclosure relates to casting of single crystal or directionally solidified castings.

A gas turbine engine typically includes a fan section, a compressor section, a combustor section and a turbine section. Air entering the compressor section is compressed and delivered into the combustor section where it is mixed with fuel and ignited to generate a high-speed exhaust gas flow. The high-speed exhaust gas flow expands through the turbine section to drive the compressor section and the fan section.

In a two spool engine, the compressor section typically includes low and high pressure compressors, and the turbine section includes low and high pressure turbines.

The high pressure turbine drives the high pressure compressor through an outer shaft to form a high spool, and the low pressure turbine drives the low pressure compressor through an inner shaft to form a low spool. The fan section may also be driven by the low inner shaft. A direct drive gas turbine engine includes a fan section driven by the low spool such that the low pressure compressor, low pressure turbine and fan section rotate at a common speed in a common direction.

A speed reduction device such as an epicyclical gear assembly may be utilized to drive the fan section such that the fan section may rotate at a speed different than the driving turbine section so as to increase the overall propulsive efficiency of the engine. In such engine architectures, a shaft driven by one of the turbine sections provides an input to the epicyclical gear assembly that drives the fan section at a reduced speed such that both the turbine section and the fan section can rotate at closer to optimal speeds.

SUMMARY

One aspect of the disclosure involves casting an alloy part in a mold having a part-forming cavity. The method comprises pouring a first alloy into the mold. The pouring causes: a surface of the first alloy in the part-forming cavity to raise relative to the part-forming cavity; a branch flow of the poured first alloy to pass upwardly through a first portion of a passageway; and the branch flow to pass downwardly through a second portion of the passageway; solidifying some of the first alloy in the passageway to block the passageway while at least some of the first alloy in the part-forming cavity remains molten. A second alloy is poured into the mold atop the first alloy and solidified.

A further embodiment may additionally and/or alternatively include the pouring of the first alloy terminating before the blocking of the passageway.

A further embodiment may additionally and/or alternatively include the passageway having an enlarged reservoir portion distally of or formed by the second portion.

A further embodiment may additionally and/or alternatively include the mold being progressively cooled to provide an upwardly moving solidification front which passes through the first alloy to the second alloy to completely solidify the article.

A further embodiment may additionally and/or alternatively include a boundary between respective regions formed by the first alloy and the second alloy being determined by the position of a junction of the passageway first portion and passageway second portion.

A further embodiment may additionally and/or alternatively include the first alloy and second alloy being introduced through a downsprue which telescopes between first and second conditions.

A further embodiment may additionally and/or alternatively include the first alloy and second alloy being introduced through the same port.

A further embodiment may additionally and/or alternatively include the first alloy being bottom-fed via a downsprue and the second alloy being top-fed.

A further embodiment may additionally and/or alternatively include a crystalline structure propagating across a transition from the first alloy to the second alloy.

A further embodiment may additionally and/or alternatively include the crystalline structure being initiated by a grain starter.

A further embodiment may additionally and/or alternatively include the part being a blade and the part-forming cavity comprising: a root portion for casting an attachment root of the blade; and an airfoil portion for casting an airfoil of the blade, the airfoil having a first end and a second end and a span between the first end and the second end.

A further embodiment may additionally and/or alternatively include there being no additional pours.

Another aspect of the disclosure involves a casting mold comprising: a part-forming cavity having a lower end and an upper end; and at least one overflow passageway having an apex at a level between the upper end and the lower end.

A further embodiment may additionally and/or alternatively include the part being a blade and the part-forming cavity comprising: a root portion for casting an attachment root of the blade; and an airfoil section for casting an airfoil of the blade, the airfoil having a first end and a second end and a span between the first end and the second end.

A further embodiment may additionally and/or alternatively include the apex being at a level along the span.

A further embodiment may additionally and/or alternatively include a grain starter below the part-forming cavity.

A further embodiment may additionally and/or alternatively include the overflow passageway comprising an uppass from the part-forming cavity to the apex and a downpass from the apex and including an enlarged chamber.

A further embodiment may additionally and/or alternatively include: a pour cone; and a downsprue extending from the pour cone toward the part-forming cavity and comprising: a lower portion having a plurality of ports in communication with the part-forming cavity; and an upper portion telescoping relative to the lower portion and coupling the lower portion to the pour cone.

A further embodiment may additionally and/or alternatively include: a first pour cone; a downsprue extending from the first pour cone toward the part-forming cavity; and a second pour cone in communication with the part-forming cavity.

A further embodiment may additionally and/or alternatively include a casting apparatus, the casting apparatus having: a first ingot feeder; a first induction melter positioned to receive an ingot from the first ingot feeder; a first actuator for rotating the first induction melter from a charging orientation to a pouring orientation for pouring into the part-forming cavity; a second ingot feeder; a second induction melter positioned to receive an ingot from the second ingot feeder; and a second actuator for rotating the second induction melter from a charging orientation to a pouring orientation for pouring into the part-forming cavity.

Another aspect of the disclosure involves a casting apparatus having: a first molten metal source; a second molten metal source and a furnace section for holding a mold to receive the first molten metal and the second molten metal.

A further embodiment may additionally and/or alternatively include: the first molten metal source comprising: a first ingot feeder; a first induction melter positioned to receive an ingot from the first ingot feeder; and a first actuator for rotating the first induction melter from a charging orientation to a pouring orientation; and the second molten metal source comprising: a second ingot feeder; a second induction melter positioned to receive an ingot from the second ingot feeder; and a second actuator for rotating the second induction melter from a charging orientation to a pouring orientation.

A further embodiment may additionally and/or alternatively include: the first molten metal source comprising: a first ingot feeder; a first electron beam source positioned to heat an ingot from the first ingot feeder; a first hearth; and a first actuator for rotating the first hearth from a charging orientation to a pouring orientation; and the second molten metal source comprising: a second ingot feeder; a second beam source positioned to heat an ingot from the second ingot feeder; a second hearth; and a second actuator for rotating the second hearth from a charging orientation to a pouring orientation.

Another aspect of the disclosure involves a casting mold comprising: a part-forming cavity having a lower end and an upper end; a pour cone; and a downsprue extending from the pour cone toward the part-forming cavity and comprising: a lower portion having a plurality of ports in communication with the part-forming cavity; and an upper portion telescoping relative to the lower portion and coupling the lower portion to the pour cone.

A further embodiment may additionally and/or alternatively include the mold along the part-forming cavity and the lower portion being formed as a single piece.

A further embodiment may additionally and/or alternatively include the part-forming cavity being one of a plurality of part-forming cavities, each of the plurality of part-forming cavities coupled to a single said downsprue.

A further embodiment may additionally and/or alternatively include a method for using the casting mold, the method comprising: introducing a molten alloy to the part-forming cavity through the pour cone and a lower port of the plurality of ports; extending the upper portion relative to the lower portion; and introducing a molten alloy to the part-forming cavity through the pour cone and an upper port of the plurality of ports.

A further embodiment may additionally and/or alternatively include one or more of: the molten alloy introduced through the upper port is different from the molten alloy introduced through the lower port; the molten alloy introduced through the upper port is introduced after a partial solidification of the molten alloy introduced through the lower port; and the molten alloy introduced through the upper port is introduced from a second ingot and the molten alloy introduced through the lower port is introduced from a first ingot.

Another aspect of the disclosure involves a method for casting with a mold having a plurality of part cavities, the method comprising: a first pour through a first pour cone, the first pour filling a lower portion of each of the part cavities; and a second pour through a second pour cone, the second pour filling an upper portion of each of the part cavities.

A further embodiment may additionally and/or alternatively include the first pour cone being concentric with the second pour cone.

A further embodiment may additionally and/or alternatively include the first pour being a bottom feed and the second pour being a top feed.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

The '530 application discloses multi-shot cast articles, alloys and alloy combinations for such articles, molds for casting such articles, and methods for casting such articles.

The molds, methods, and apparatus herein may be used for casting articles which may include any or all such articles as disclosed in the '530 application. Similarly, the methods and apparatus herein, may be used with molds which may include any or all such molds as disclosed in the '530 application.

Figure 1:
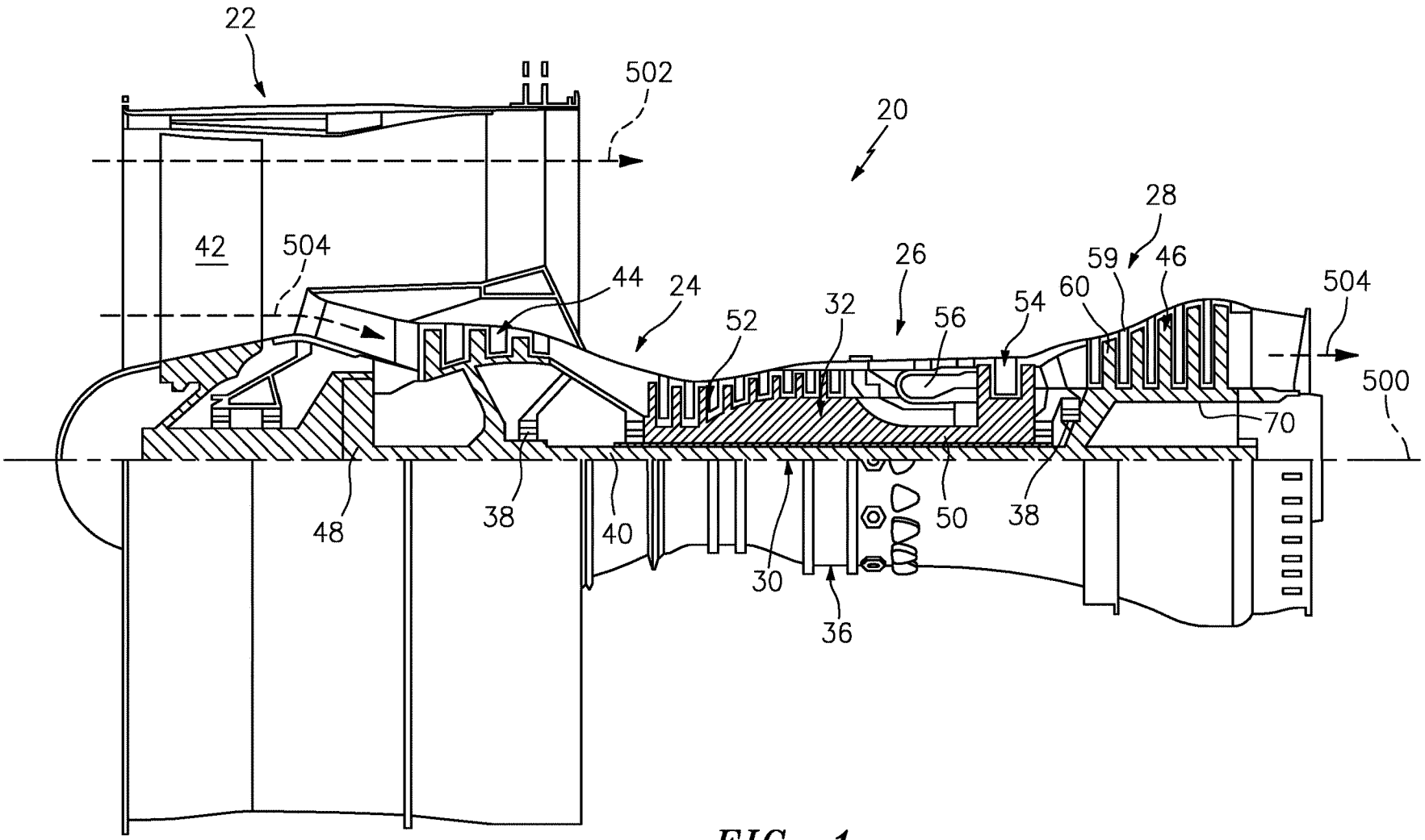
FIG. 1 is a partially schematic half-sectional view of a gas turbine engine.

FIG. 1 schematically illustrates a gas turbine engine 20. The exemplary gas turbine engine 20 is a two-spool turbofan having a centerline (central longitudinal axis) 500, a fan section 22, a compressor section 24, a combustor section 26 and a turbine section 28. Alternative engines might include an augmentor section (not shown) among other systems or features. The fan section 22 drives air along a bypass flowpath 502 while the compressor section 24 drives air along a core flowpath 504 for compression and communication into the combustor section 26 then expansion through the turbine section 28. Although depicted as a turbofan gas turbine engine in the disclosed non-limiting embodiment, it is to be understood that the concepts described herein are not limited to use with turbofan engines and the teachings can be applied to non-engine components or other types of turbomachines, including three-spool architectures and turbine engines that do not have a fan section.

The engine 20 includes a first spool 30 and a second spool 32 mounted for rotation about the centerline 500 relative to an engine static structure 36 via several bearing systems 38. It should be understood that various bearing systems 38 at various locations may alternatively or additionally be provided.

The first spool 30 includes a first shaft 40 that interconnects a fan 42, a first compressor 44 and a first turbine 46. The first shaft 40 is connected to the fan 42 through a gear assembly of a fan drive gear system (transmission) 48 to drive the fan 42 at a lower speed than the first spool 30. The second spool 32 includes a second shaft 50 that interconnects a second compressor 52 and second turbine 54. The first spool 30 runs at a relatively lower pressure than the second spool 32. It is to be understood that "low pressure" and "high pressure" or variations thereof as used herein are relative terms indicating that the high pressure is greater than the low pressure. A combustor 56 (e.g., an annular combustor) is between the second compressor 52 and the second turbine 54 along the core flowpath. The first shaft 40 and the second shaft 50 are concentric and rotate via bearing systems 38 about the centerline 500.

The core airflow is compressed by the first compressor 44 then the second compressor 52, mixed and burned with fuel in the combustor 56, then expanded over the second turbine 54 and first turbine 46. The first turbine 46 and the second turbine 54 rotationally drive, respectively, the first spool 30 and the second spool 32 in response to the expansion.

Figure 2:
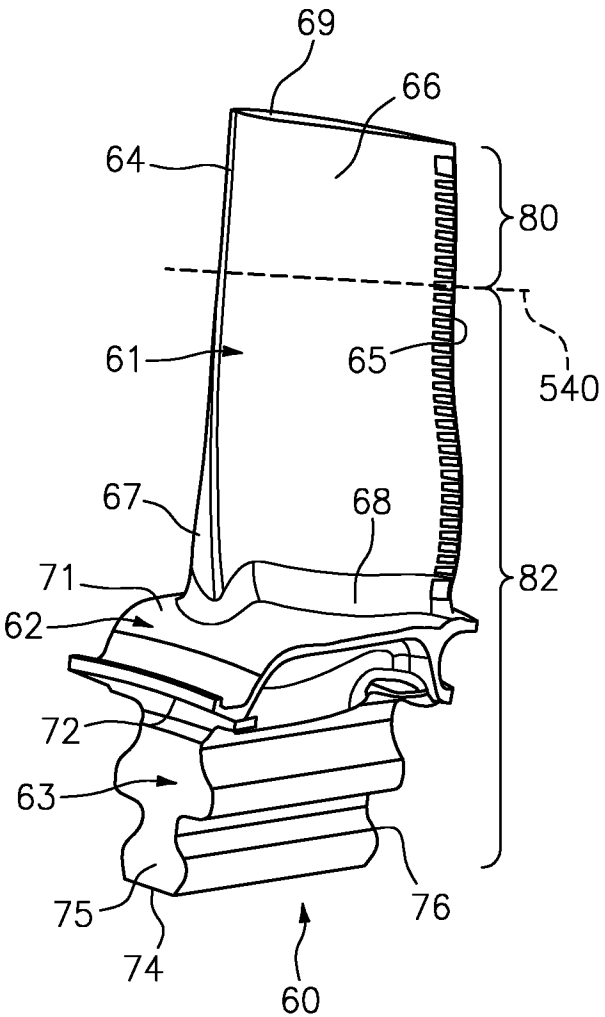
FIG. 2 is a view of a turbine blade of the engine of FIG. 1.

The engine 20 includes many components that are or can be fabricated of metallic materials, such as aluminum alloys and superalloys. As an example, the engine 20 includes rotatable blades 60 and static vanes 59 in the turbine section 28. The blades 60 and vanes 59 can be fabricated of superalloy materials, such as cobalt- or nickel-based alloys. The blade 60 (FIG. 2) includes an airfoil 61 that projects outwardly from a platform 62. A root portion 63 (e.g., having a "fir tree" profile) extends inwardly from the platform 62 and serves as an attachment for mounting the blade in a complementary slot on a disk 70 (shown schematically in FIG. 1). The airfoil 61 extends streamwise from a leading edge 64 to a trailing edge 65 and has a pressure side 66 and a suction side 67. The airfoil extends spanwise from an inboard end 68 at the outer diameter (OD) surface 71 of the platform 62 to a distal/outboard end/tip 69 (shown as a free tip rather than a shrouded tip in this example).

The root 63 extends from an outboard end at an underside 72 of the platform to an inboard end 74 and has a forward face 75 and an aft face 76 which align with corresponding faces of the disk when installed.

The blade 60 has a body or substrate that has a hybrid composition and microstructure. For example, a "body" is a main or central foundational part, distinct from subordinate features, such as coatings or the like that are supported by the underlying body and depend primarily on the shape of the underlying body for their own shape. As can be appreciated however, although the examples and potential benefits may be described herein with respect to the blades 60, the examples can also be extended to the vanes 59, disk 70, other rotatable metallic components of the engine 20, non-rotatable metallic components of the engine 20, or metallic non-engine components.

The blade 60 has a tipward first section 80 fabricated of a first material and a rootward second section 82 fabricated of a second, different material. A boundary between the sections is shown as 540. For example, the first and second materials differ in at least one of composition, microstructure and mechanical properties. In a further example, the first and second materials differ in at least density. In one example, the first material (near the tip of the blade 60) has a relatively low density and the second material has a relatively higher density. The first and second materials can additionally or alternatively differ in other characteristics, such as corrosion resistance, strength, creep resistance, fatigue resistance, or the like.

In this example, the sections 80/82 each include portions of the airfoil 61. Alternatively, or in addition to the sections 80/82, the blade 60 can have other sections, such as the platform 62 and the root portion 63, which may be independently fabricated of third or further materials that differ in at least one of composition, microstructure and mechanical properties from each other and, optionally, also differ from the sections 80/82 in at least one of composition, microstructure, and mechanical properties.

In this example, the airfoil 61 extends over a span from 0% span at the platform 62 to a 100% span at the tip 69. The section 82 extends from the 0% span to X % span (at boundary 540) and the section 80 extends from the X % span to the 100% span. In one example, the X % span is, or is approximately, 70% such that the section 80 extends from 70% to 100% span. In other examples, the X % can be anywhere from 1%-99%. In a further example, the densities of the first and second materials differ by at least 3%. In a further example, the densities differ by at least 6%, and in one example differ by 6%-10%. As is discussed further below, the X % span location and boundary 540 may represent the center of a short transition region between sections of the two pure first and second materials.

The first and second materials of the respective sections 80/82 can be selected to locally tailor the performance of the blade 60. For example, the first and second materials can be selected according to local conditions and requirements for corrosion resistance, strength, creep resistance, fatigue resistance or the like. Further, various benefits can be achieved by locally tailoring the materials. For instance, depending on a desired purpose or objective, the materials can be tailored to reduce cost, to enhance performance, to reduce weight or a combination thereof.

In one example, the blade 60, or other hybrid component, is fabricated using a casting process. For example, the casting process can be an investment casting process that is used to cast a single crystal microstructure, a directional (columnar) microstructure, or an equiaxed microstructure. In one example of fabricating the blade 60 by casting, the casting process introduces two, or more, alloys that correspond to the first and second (or more) materials. For example, the alloys are poured into an investment casting mold at different stages in the cooling cycle to form the sections 80/82 of the blade 60. The following example is based on a directionally solidified, single crystal casting technique to fabricate a nickel-based blade, but can also be applied to other casting techniques, other material compositions, and other components.

At least two nickel-based alloys of different composition (and different density upon cooling) are poured into an investment casting mold at different stages of the withdrawal and solidification process of the casting. For instance, in a tip-upward casting example of the blade 60, the alloy corresponding to the second material is poured into the mold to form the root 63, the platform 62 and the airfoil portion of second section 82. As the mold is withdrawn from the heating chamber, the alloy in the root 63 begins to solidify. With further withdrawal, a solidification front moves upwards (in this example) toward the platform 62 and airfoil portion of the second section 82. Prior to complete solidification of the alloy at the top of the second section 82, another alloy corresponding to the first material of the first section 80 is poured into the mold. The additional alloy mixes in a liquid state with the still liquid alloy at the top of the second section 82. As the solidification front continues upwards, the two mixed alloys solidify in a boundary portion (zone) between the sections 80/82. As additional alloy of the first material is poured into the mold, the boundary zone transitions to fully being alloy of the first material as the first section 80 solidifies. Thus, the boundary zone provides a strong metallurgical bond between the two alloys of the sections 80/82 from the mixing of the alloys in the liquid state, and thus does not have some of the drawbacks of solid-state bonds (e.g., solid state bonds providing locations for crack initiation).

In single crystal investment castings, a seed of one alloy can be used to preferentially orient a compositionally different casting alloy. Furthermore, nickel-based alloy coatings strongly bond to nickel-based alloy substrates of different composition. The seeding and bonding suggests that the approach of multi-material casting with the metallurgical bond of the boundary zone is feasible to produce a strong bond.

Additionally, lattice parameters and thermal expansion mismatches between different composition nickel-based alloys are relatively insignificant, which suggests that the boundary between the sections 80/82 is unlikely to be a detrimental structural anomaly. Also, for nickel-based alloys, unless such boundary zones are subjected to temperatures in excess of 2000° F. (1093° C.) for substantial periods of time, it is unlikely that the compositions and microstructural stability in the boundary zone will be significantly compromised. Alternatively, the alloys can be selected to reduce or mitigate any such effects to meet engineering requirements. As can be further appreciated, the same approach can be applied to conventionally cast components with equiaxed grain structure, as well directionally solidified castings with columnar grain structure.

For a rotatable component, such as the blade 60 or disk 70, the centrifugal pull at any location is proportional to the product of mass, radial distance from the center and square of the angular velocity (proportional to revolutions per minute). Thus, the mass at the tip has a greater pull than the mass near the attachment location. By the same token, the strength requirement near to the rotational axis is much higher than the strength requirement near the tip. Therefore, the blade 60 having the first section 80 fabricated of a relatively low density material (near the tip) can be beneficial, even if the selected material of the first section 80 does not have the same strength capability as the material selected for the second section 82.

Also, the radial pull is significantly higher than the pressure load experienced by the blade 60 along the engine central axis 500. This suggests that the blade 60, with a low density/low strength alloy at the tip, would be greatly beneficial to the engine 20 by either improving engine efficiency or by modifying blade geometry for a longer or broader blade or by reducing the pull on the disk 70 and reducing the engine weight, as well as shrinking the bore of the disk 70 axially, thereby improving the engine architecture.

Similarly, in some embodiments, it can be beneficial to fabricate the root 63 of the blade 60 with a more corrosion resistant and stress corrosion resistant (SCC) alloy and to fabricate the airfoil 61 (or portions thereof) with a more creep resistant alloy. Given that not all engineering properties are required to the same extent at different locations in a component, the weight, cost, and performance of a component, such as the blade 60, can be locally tailored to thereby improve the performance of the engine 20.

The examples herein may be used to achieve various purposes, such as but not limited to, (1) light weight components such as blades, vanes, seals etc., (2) blades with light weight tip and/or shroud, thereby reducing the pull on the blade root attachment and rotating disk, (3) longer or wider blades improving engine efficiency, rather than reducing the weight, (4) corrosion and SCC resistant roots with creep resistant airfoils, (5) root attachments with high tensile and low cycle fatigue strength and airfoils with high creep resistance, (6) reduced use of high cost elements such as Re in the root portion 63 or other locations, and (7) reduction in investment core and shell reactions with active elements in in one or more of the zones. An example of the last purpose involves a situation where more of a particular element is desired in one zone than in another zone. For example in a blade it may be desired to have more of certain reactive elements (e.g., that contribute to oxidation resistance) in the airfoil (or other tipward zone) than in the root (or other rootward zone). In a single-pour tip-downward casting, the alloy will have a greater time in the molten state as one progresses from tip to root. There will be more time for the reactive elements to react with core and shell near the root. Although this can yield acceptable amounts of those reactive elements in the blade, the reaction can degrade the interface between casting and core/shell. The reactions may alter local core/shell compositions so as to make it difficult to reach the core. Thus, the later pour (forming the root in this example) may be of an alloy having relatively low (or none) concentrations of the reactive elements.

Additionally, in some embodiments, the examples herein provide the ability to enhance performance without using costly ceramic matrix composite materials. The examples herein can also be used to change or expand the blade geometry, which is otherwise limited by the blade pull, disk strength and space availability. Furthermore, the examples expand the operating envelope of the geared architecture of the engine 20, where higher rotational speeds of the hot, turbine section 20 are feasible since the rotational speed of the turbine section 28 is not necessarily constrained by the rotational speed of the fan 42 because the fan speed can be adjusted through the gear ratio of the gear assembly 48.

Typically a single crystal nickel-base superalloy component, such as a turbine blade may be cast as follows. A ceramic and/or a refractory metal core or assembly is made, which will ultimately define the internal hollow passages in the turbine blade. Using a die, wax is injected around the core to form a pattern which will eventually define the external shape of the blade. The solid wax with embedded core assembly (and optionally with other wax gating components or additional patterns attached) is then dipped in ceramic slurry to form the outer shell mold. Once the shell is dried, the wax is melted and drained out leaving behind a hollow cavity between the outer shell and the inner core. The assembly is then fired to harden the shell (mold).

Such a mold assembly (typically with a feed tube (e.g. a downsprue for bottom fill shells) and a pour cup) is then placed on a water-cooled chill plate inside an induction heated furnace, enclosed in a vacuum chamber. These features (tube, downsprue, pour cup) may be formed by shelling wax pattern elements either with or separately from the shelling of the blade patterns.

If the alloy is to be cast with the naturally favored <100> orientation along the long axis (the spanwise direction) of the blade the shell may include means such as a hollow helical passage joined to a hollow cavity at the bottom, to form a starter block (grain starter). Wax forming the helix and block may be molded as part of the pattern or secured thereto prior to shelling.

If it is desired to cast the alloy with controlled crystal orientation, then the hollow cavity below the helical passage may be filled with a block of solid single crystal of the desired orientation. This solid block is referred to as a seed. This seed need not be parallel to the axis of the blade. It may be tilted at a desired angle. That provides flexibility in selecting the starting seed and the desired orientation of the casting.

If the mold assembly were to be grown naturally with no seed, then a molten metal charge is melted in the melt cup or crucible and poured through the pour cup to fill the mold. The mold can be top fed or bottom fed. A filter may be used in the feed tube to capture any ceramic or solid inclusion in the liquid metal as shown. Once the mold is filled, the radiation from the susceptors heated by the induction coils keep the metal molten. Subsequently the mold is withdrawn from the furnace past/through the baffle which isolates the hot zone of the furnace from the cold zone below. Typically the withdrawal rate is 1-10 inches/hour (2.5 mm/hour to 0.25 m/hour), depending on the complexity and size of the part. The part of the mold that gets withdrawn below the baffle starts solidifying due to the rapid cooling from the chill plate. Since that solidification is largely due to heat transfer through the chill plate it is highly biased in the direction of withdrawal. That is why the process is called directional solidification. Due to directional solidification, the starter block forms columns of grain of crystal of which the helical passage allows only one to survive. This results in a single crystal casting with <100> crystallographic or cube direction parallel to the blade axis.

If the mold is designed to be started with a seed, then it may be positioned in such a way that half of the seed is initially below the baffle. Now when the molten metal is poured, the half of the seed above the baffle melts and mixes with the new metal. Soon after this occurs, the mold is withdrawn as described above. In this case however, the metal cast in the mold becomes single crystal with the orientation defined by the seed.

According to the present disclosure, a compositional variation may be imposed along the blade. This may entail two or more zones with transitions in between.

An exemplary two-zone blade involves a transition at a location 540 along the airfoil.

For example, an inboard region of the airfoil is under centrifugal load from the portion outboard thereof (e.g., including any shroud). Reducing density of the outboard portion reduces this loading and is possible because the outboard portion may be subject to lower loading (thus allowing the outboard portion to be made of an alloy weaker in creep). An exemplary transition location 540 may be between 30% and 80% span, more particularly 50-75% or 60-75% or an exemplary 70%.

To create such compositional zones, the mold cavity may be filled with a given alloy to a desired intermediate height determined by the design requirement.

In a tip-downward casting example, a low density first alloy may be poured just sufficient to fill the outboard portion, and withdrawal process begins. As the transition location in the cavity approaches the baffle, a second alloy with higher creep strength is poured to fill the rest of the mold. This may be achieved by adding ingot(s) of the second alloy in the melt crucible and pouring the molten second alloy into the pour cup.

Both the withdrawal process and the second pouring may be coordinated in such a way that minimal mixing of the alloys occurs so that large composition gradients between essentially pure bodies of the two alloys are brief (e.g., less than 10% span or less than 5% span).

It is possible the first alloy may be completely solidified before adding the second alloy, but mixing may occur with just sufficient remaining initial alloy in the liquid state to provide a robust transition to the second alloy. Similarly, multiple pours of a given alloy are possible (e.g., splitting the pouring of the second alloy into two pours after the pour of the first alloy such that a first pour of the second alloy forms a transition region with remaining molten first alloy and is allowed to partially or fully solidify before a second pour of the second alloy is made).

Various modifications and optimizations may be made. If needed such a process may also benefit with the addition of deoxidizing elements like Ca, Mg, and similar active elements. However, an exemplary approach is to avoid that to provide clean practice and process control.

The procedure described above can be practiced with multiple alloys and any section of the casting desired. It is understood that where one wants the transition between two or more alloys to take place depends on the optimized design and desired performance of the particular components. This is controlled by yield strength, fatigue strength, creep strength, as well as desired oxidation resistance and corrosion resistance of the alloy candidate(s) chosen. The key physical basis to be recognized is that the epitaxial crystallographic relationship is maintained when casting alloys within the class of FCC solid solution hardened and precipitation hardened nickel base alloys used for blades and other gas turbine engine and industrial engine components.

It is understood that a lack of epitaxial relationship leading to formation of a grain boundary may be tolerable if such structurally weak interfaces are sufficiently strengthened by alloying additions and/or are acceptable for the specific structural design such as a long blade with less pull at the location.

If the second nickel base alloy is a typical coating-type composition with high concentration of aluminum, having a mix of face centered cubic, and body centered cubic or simple cubic or B2 structure, this approach will also work. Such a combination may be desirable in case one wants the latter alloy to be oxidation resistant or have a higher thermal conductivity. In such a situation, epitaxial relationship is not expected but interfacial bond may be acceptable as formed in liquid state or by inter-diffusion.

The foregoing discusses a method for making multi-alloy single-crystal castings. However, a similar method may provide a low cost columnar grain structure. In such case the casting may still be carried out by directional solidification but no helical passage is used to filter out only one grain. Instead, multiple columnar grains are allowed to run through the casting.

Figure 3:
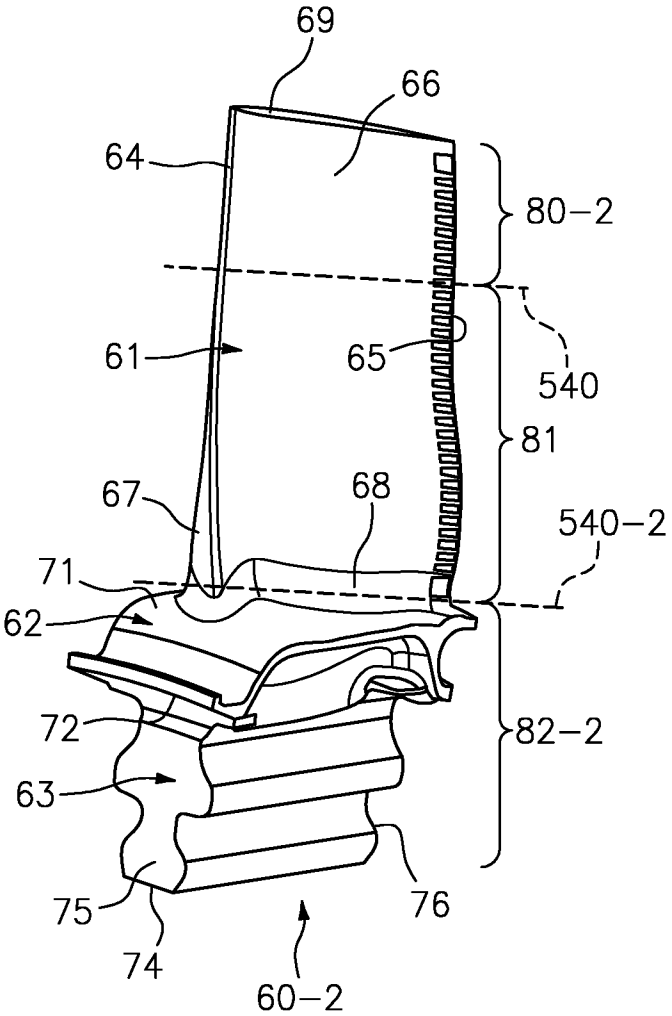
FIG. 3 is a view of an alternative turbine blade of the engine of FIG. 1.

FIG. 3 divides the blade 60-2 into three zones (a tipward Zone 1 numbered 80-2; a rootward Zone 2 numbered 82-2; and an intermediate Zone 3 numbered 81) which may be of two or three different alloys (plus transitions). Desired relative alloy properties for each zone are:

Zone 1 Airfoil Tip: low density (desirable because this zone imposes centrifugal loads on the other zones) and high oxidation resistance. This may also include a tip shroud (not shown);

Zone 2 Root & Fir Tree: high notched LCF strength, high stress corrosion cracking (SCC) resistance, low density (low density being desirable because these areas provide a large fraction of total mass);

Zone 3 Lower Airfoil: high creep strength (due to supporting centrifugal loads with a small cross-section), high oxidation resistance (due to gaspath exposure and heating), higher thermal-mechanical fatigue (TMF) capability/life.

Exemplary Zone 1/3 transition 540 is at 50-80% airfoil span, more particularly 55-75% or 60-70% (e.g., measured at the center of the airfoil section or at half chord). Exemplary Zone 2/3 transition 540-2 is at about 0% span (e.g., −5% to 5% or −10% to 10%).

Table I (split into Tables I A and I B) shows compositions of three groups of alloys which may be used in various combinations of a two-zone or three-zone blade. Relative to the other groups, general relative properties are:

Group A: high creep strength & oxidation resistance;

Group B: low density and good oxidation resistance; and

Group C: high attachment LCF strength and stress corrosion cracking (SCC) resistance.

TABLE I A

| | | Composition, Weight % | | | | | | | | | | | | |
|---|---|---|---|---|---|---|---|---|---|---|---|---|---|---|
| Alloy | Alloy Group | Cr | Ti | Mo | W | Ta | Other | Al | Co | Re | Ru | Hf | C | Y |
| PWA 1484 | A | 5 | | 1.9 | 5.9 | 8.7 | | 5.65 | 10 | 3 | | 0.1 | | |
| PWA 1487 | | 5 | | 1.9 | 5.9 | 8.7 | | 5.65 | 10 | 3 | | 0.35 | | 0.01 |
| PWA 1497 | | 2 | | 1.8 | 6 | 8.25 | | 5.65 | 16.5 | 6 | 3 | 0.15 | 0.05 | |
| Rene N5 | | 7 | | 1.5 | 5 | 6.5 | | 6.2 | 7.5 | 3 | | 0.15 | | 0.01 |
| Rene N6 | | 4 | | 1 | 6 | 7 | | 5.8 | 12 | 5 | | 0.2 | | |
| CMSX-4 | | 6.5 | 1 | 0.6 | 6 | 6.5 | | 5.6 | 9 | 3 | | 0.1 | | |
| PWA 1430 | | 3.75 | | 1.9 | 8.9 | 8.7 | | 5.85 | 12.5 | 0 | | 0.3 | | |
| Rene N500 | | 6 | | 2 | 6 | 6.5 | | 6.2 | 7.5 | 0 | | 0.6 | | |
| Rene N515 | | 6 | | 2 | 6 | 6.5 | | 6.2 | 7.5 | 1.5 | | 0.38 | | |
| TMS-138A | | 3.2 | | 2.8 | 5.6 | 5.6 | | 5.7 | 5.8 | 5.8 | 3.6 | 0.1 | | |
| TMS-196 | | 4.6 | | 2.4 | 5 | 5.6 | | 5.6 | 5.6 | 6.4 | 5 | 0.1 | | |
| TMS-238 | | 4.6 | | 1.1 | 4 | 7.6 | | 5.9 | 6.5 | 6.4 | 5 | 0.1 | | |
| CMSX-10 | | 2 | 0.2 | 0.4 | 5 | 8 | 0.05Nb | 5.7 | 3 | 6 | | 0.1 | | |
| CM 186LC | | 6 | 0.7 | 0.5 | 8 | 3 | | 5.7 | 9 | 3 | | 1.4 | 0.07 | |
| CMSX-486 | | 5 | 0.7 | 0.7 | 9 | 4.5 | | 5.7 | 9 | 3 | | 1 | 0.07 | |
| CMSX-7 | | 6 | 0.8 | 0.6 | 9 | 9 | | 5.7 | 10 | 0 | | 0.3 | | |
| CMSX-8 | | 5.4 | 0.7 | 0.6 | 8 | 8 | | 5.7 | 10 | 1.5 | | 0.3 | | |
| LDSX-B | | 8 | | 1.1 | 2 | 4 | | 6.2 | 12.5 | 5 | 2 | 0.1 | | |

TABLE I B

| | | Composition, Weight % | | | | | | | | | | | | |
|---|---|---|---|---|---|---|---|---|---|---|---|---|---|---|
| Alloy | Alloy Group | Cr | Ti | Mo | W | Ta | Other | Al | Co | Re | Ru | Hf | C | Y |
| CMSX-6 | B | 10 | 4.7 | 3 | | 2 | | 4.8 | 5 | | | 0.1 | | |
| Y-1715 GE | | 13 | | | 3.8 | 4.9 | | 6.6 | 7.5 | 1.6 | | 0.14 | 0.04 | |
| LEK-94 | | 6.1 | 1 | 2 | 3.4 | 2.3 | | 6.6 | 7.5 | 2.5 | | 0.1 | | |
| RR-2000 | | 10 | 4 | 3 | | | 1.0V | 5.5 | 15 | | | | | |
| AM 3 | | 8 | 2 | 2 | 5 | 4 | | 6 | 6 | | | | | |
| LDSX-B | | 8 | | 1.1 | 2 | 4 | | 6.2 | 12.5 | 5 | 2 | 0.1 | | |
| LDSX-D | | 6 | | 2 | 4 | 4 | | 6.2 | 12.5 | 5 | 2 | 0.1 | | |
| New 1 | | 5 | | 1 | 3 | 2 | | 6 | 5 | | | 0.1 | | |
| New 2 | | 5 | | 1 | 3 | 2 | | 6.5 | 5 | 3 | | 0.1 | | |
| New 3 | | 8 | | 1 | 3 | 2 | | 6.5 | 5 | | | 0.1 | | |
| New 4 | | 8 | | 1 | 3 | 2 | | 6.5 | 5 | 3 | | 0.1 | | |
| PWA 1480 | C | 10 | 1.5 | | 4 | 12 | | 5 | 5 | | | | | |
| PWA 1440 | | 10 | 1.5 | | 4 | 12 | | 5 | 5 | | | 0.35 | | |
| PWA 1483 | | 12.2 | 4.1 | 1.9 | 3.8 | 5 | | 3.6 | 9 | | | | 0.07 | |
| CMSX-2 | | 8 | 1 | 0.6 | 8 | 6 | | 5.6 | 5 | | | | | |

An exemplary two-alloy blade involves a Group A alloy inboard (e.g. along at least part and more particularly all of the root, e.g., in zones 81 and 82-2 or zone 82) and a Group B alloy along at least part of the airfoil (e.g., a portion extending inward from the tip such as zone 80-2 or zone 80). Suitable two-shot examples selected from these three groups are given immediately below followed by a three shot example.

Another exemplary two-alloy blade involves a Group A along all or most of the airfoil (e.g., tip inward such as zones 80-2 and 81 or zone 80) and a Group C alloy along at least part of the root (e.g., a root majority or zone 82-2 or zone 82).

An exemplary three-alloy blade involves a Group C alloy inboard (e.g., zone 82-2), a Group B alloy outboard (e.g., zone 80-2), and a Group A alloy in between (e.g., zone 81).

For each of the compositions there may be trace or residual impurity levels of unlisted components or components for which no value is given. For each of the groups, a range may comprise the max and min values of each element across the group with a manufacturing tolerance such as 0.1 wt % or 0.2 wt % at each end. Narrower ranges may be similarly defined to remove any number of outlier compositions from either extreme.

In some further embodiments of Group A, exemplary total Mo+W+Ta+Re+Ru>16 wt %, more particularly >19 wt %. Exemplary Al>5.5 wt %, more particularly 5.6-6.4 wt % or 5.7-6.2%. Exemplary Cr>/=4 wt %, more particularly, >/=5 wt % or 4-7 wt % or 5-7 wt % or 5.0-6.5 wt %.

In some further embodiments of Group B, exemplary total Mo+W+Ta+Re+Ru<10 wt %, more particularly <7 wt % or <5 wt %. Exemplary Cr>/=5 wt %, more particularly, >/=6 wt % or 5-10 wt % or 6-9 wt %. Exemplary Al>/=5 wt % more particularly, >/=6 wt % or 6-8 wt % or 6.0-7.0 wt %.

In some further embodiments of Group C, exemplary Cr>/=8 wt %, more particularly >/=10 wt % or 8-13 wt % or 10-13 wt %. Exemplary Ta>/=5 wt %, more particularly 5-13 wt % or 6-12 wt %.

Specific alloys may be chosen to best match characteristics such as common <100> primary orientation, modulus (e.g., within 2%, more broadly 6% or 12%), thermal conductivity (e.g., within 2%, more broadly 3% or 5%, however, a much larger difference (e.g., ~5×) would occur if a nickel aluminide were used as just one of the alloys), thermal expansion (e.g., within 2%, more broadly 6% or 12%).

Figure 4:
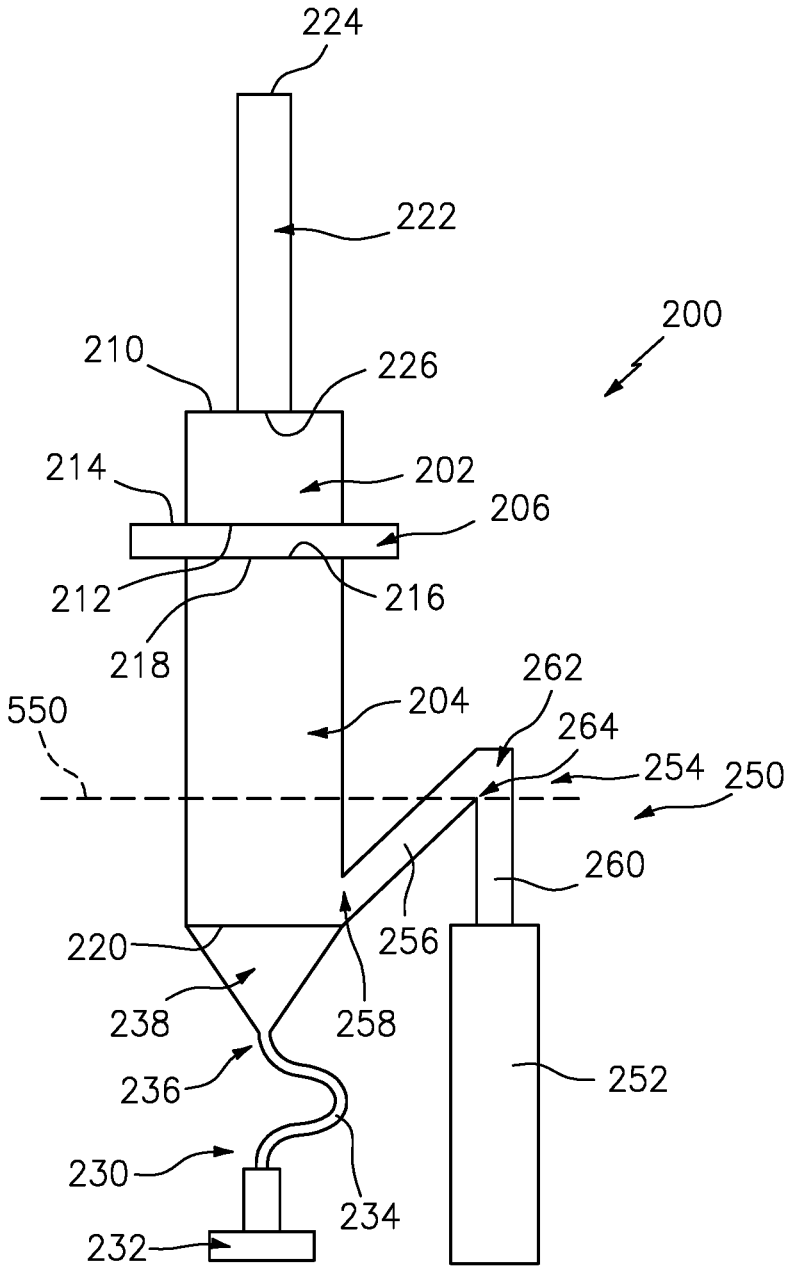
FIG. 4 is a view of a pattern for casting the blade of FIG. 2.

FIG. 4 shows a wax pattern 200 for casting a multi-alloy blade. In the exemplary pattern, the blade is to be cast in a tip-downward (root-upward) orientation. Alternative orientations are possible. The exemplary pattern 200 includes portions shaped as the corresponding portions of the blade. In the exemplary pattern this includes a root 202, an airfoil 204, and a platform 206. The root portion 202 has a first end 210 orientated upward in this illustration. The second end 212 falls along the underside 214 of the platform. The blade portion 204 extends from an end 216 at the platform outer diameter (OD) surface 218 toward a tip 220. The airfoil has a pressure side, a suction side, a leading edge, and a trailing edge as does the blade airfoil. The root 202 has a fir tree profile as does the blade root. The pattern further includes a feed portion 222 extending from an upper end 224 to a lower end 226 at the root end 210. The feed portion 222 provides a passageway in the ultimate shell/mold.

The exemplary pattern further includes a grain starter portion 230 having a larger lower portion 232 and a helical portion 234 extending upward therefrom. The helical portion 234 extends to the lower end 236 of a gating portion 238. The gating portion provides a transition between the grain starter and the part to be cast. As so far described, the pattern may be representative of any existing or future patterns. However, the exemplary pattern includes a section (portion) 250 for forming an overflow passageway and chamber in the shell/mold. The portion 250 includes an enlarged chamber-forming portion 252 and a passageway-forming portion 254. The passageway-forming portion 254 has a first leg 256 extending upward from a junction 258 with the remainder of the pattern (e.g., near the blade tip). A second leg 260 extends between a junction 262 with the first leg and the chamber-forming portion 252. As is discussed further below, a lower boundary 264 of the junction 262 defines a plane/height/level 550 associated with a boundary 540 between alloys to be cast.

Figure 5:
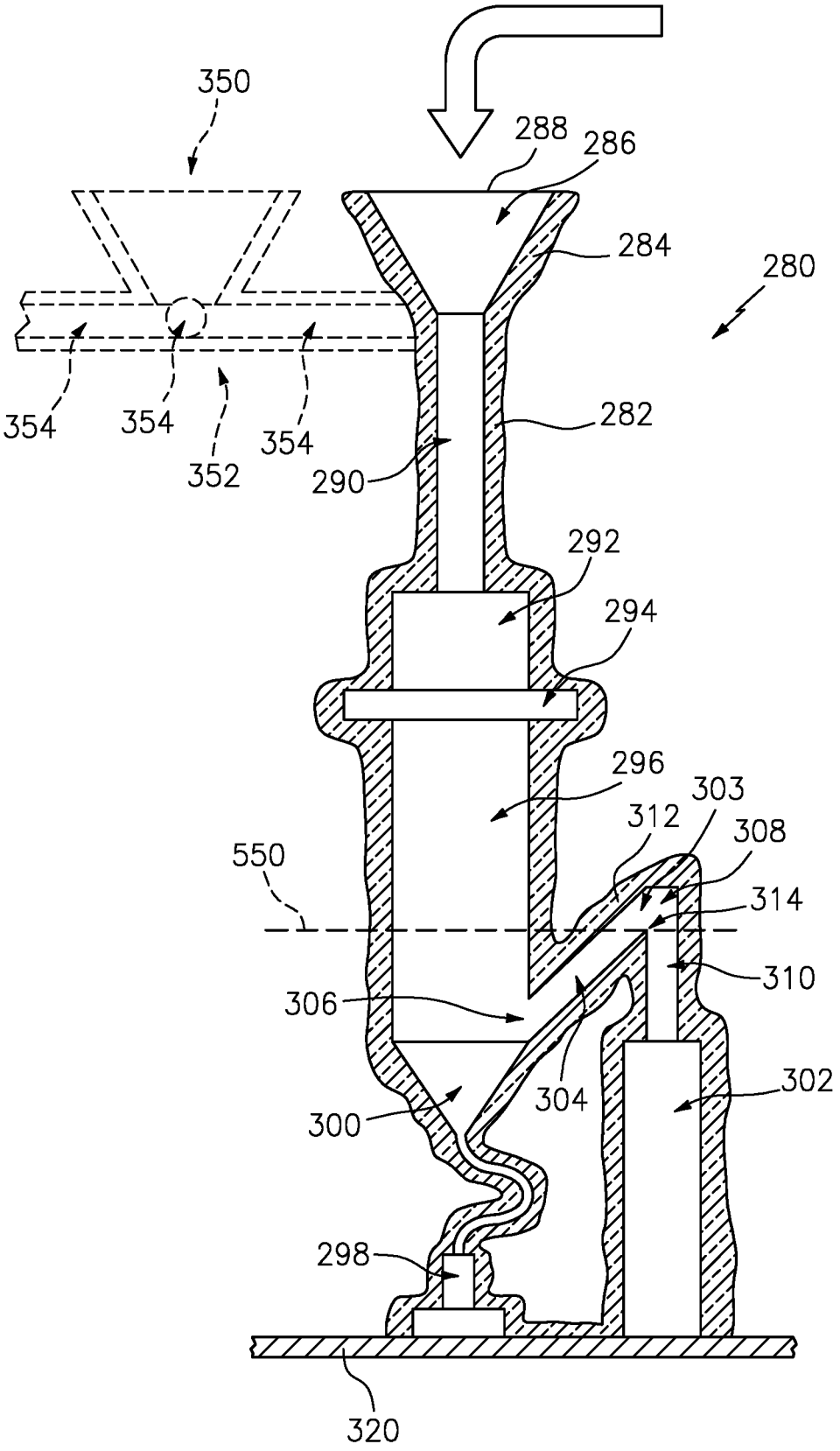
FIG. 5 is a view of a shell formed over the pattern of FIG. 4.

FIG. 5 shows a shell or mold 280 formed of ceramic material 282 formed over such a pattern 200 and having an interior space with portions corresponding to the portions of the pattern which has been removed in a de-wax process (e.g., autoclave). The exemplary shell also includes a pour cup (pour cone) 284 which may be assembled to a shell formed over the pattern 200 or may be formed simultaneously by adding a frustoconical wax body (not shown) atop the end 224 of FIG. 4. The pour cone interior 286 extends downward from a rim 288 to a junction with a feed passageway 290 formed by the feed portion 222 of FIG. 4. FIG. 5 further shows a part-forming cavity portion of the shell having a root portion 292, a platform portion 294, and an airfoil portion 296. FIG. 5 further shows the grain starter portion 298 and the gating portion 300.

FIG. 5 further shows an enlarged reservoir portion 302 corresponding to the pattern's portion 252. The passageway 303 connecting the part-forming cavity to the reservoir portion includes a first proximal leg 304 extending upward from a lower end at a port 306 along the part-forming cavity to a junction 308 with a second leg 310 of the passageway which joins the reservoir 302. FIG. 5 further shows a portion 312 of the ceramic material 282 along the passageway defining the lower end 314 of the junction 308 as an apex of a lower surface extreme of the passageway. This apex falls along the plane 550 to define the part boundary 540.

The initial pour of alloy into the part-forming cavity needs to exactly reach the level 550 to ensure repeatability. Accordingly, the first pour will include at least enough alloy to fill: the grain starter 298; the gating 300; the first passageway leg or portion 304 up to the plane 550; and airfoil portion 296 up to the plane 550. It would be difficult to provide exactly that amount. Accordingly, an additional margin of pour is provided. This additional amount will overflow through the passageway portions 304 and 310 into the reservoir 302. As long as this additional amount does not exceed the capacity of the reservoir 302 and the passageway second portion 310, the initial pour will always terminate at the plane 550. This allows precision repeatability of result.

As is discussed further below, in the casting process, the mold is on a metal chill plate 320 in the furnace. This starts solidification of the casting from the bottom up. Additionally, the mold may be withdrawn downwardly through the furnace bringing the mold progressively into a cooling zone and further upwardly-shifting the solidification front. This becomes relevant because solidifying the material in the passageway (e.g., in a lower portion of leg 304) will prevent the one or more subsequent pours from displacing the first pour further and thereby ensure the position of a boundary between the pours and their resulting solidified sections of the casting.

Figures 6A, 6B, 6C, 6D, 6E:
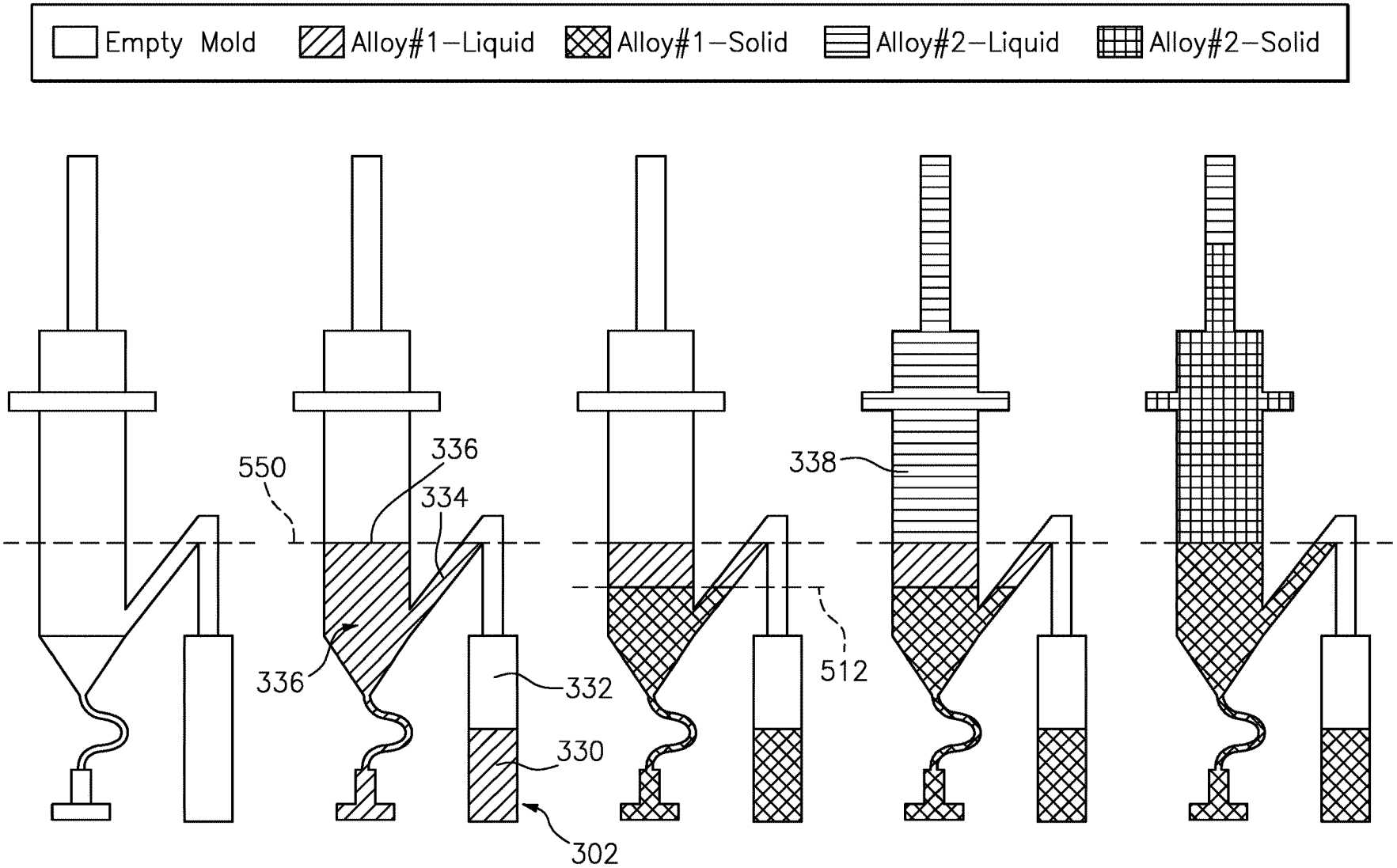
FIGS. 6A-6E show a schematic sequence of stages in the casting of two metals in the shell of FIG. 5.

FIGS. 6A-E show a sequence of instances in the pour process. In FIG. 6A, the shell or mold is schematically represented by the shape of its interior cavity and the pour cone is not illustrated. Initially, the mold is empty. In FIG. 6B, the initial pour or shot is fully made and is in a liquid state. There is an accumulation 330 of the liquid initial alloy in a lower portion of the reservoir with an empty headspace 332 thereabove extending all the way up the passageway second portion 310. There is an accumulation 334 of the initial alloy in the passageway first portion 304 up to the apex 314 and plane 550. Similarly, there is an accumulation 336 extending up from the grain starter into the part-forming cavity up to a surface 338 at the level 550. As the mold is downwardly withdrawn from the furnace, the alloy solidifies from the bottom-up. FIG. 6C shows a solidification front 552 leaving solidified alloy therebelow. In the particular instance of FIG. 6C, the solidified alloy includes a portion in the lower region of the passageway first portion 334. This blocks the passageway and prevents further introduction of alloy to the part-forming cavity from displacing more alloy into the reservoir.

The pour of the next alloy 340 may occur after the initial alloy has fully solidified. However, it may alternatively occur while some of the first alloy remains liquid (i.e., while there is still some distance between the front 552 and the plane 550). This small amount of molten material may facilitate a relatively short transition zone to the composition of the subsequent pour and thereby improve bonding between the layers/sections of the blade.

Among other variations, FIG. 5 shows, in broken line, the use of a central pour cone 350 (replacing individual pour cones 284) to feed a manifold 352 which in turn feeds a plurality of passageways 354 each joining one of the associated feed passageway 290 of an associated individual mold in a cluster of molds.

Figure 7:
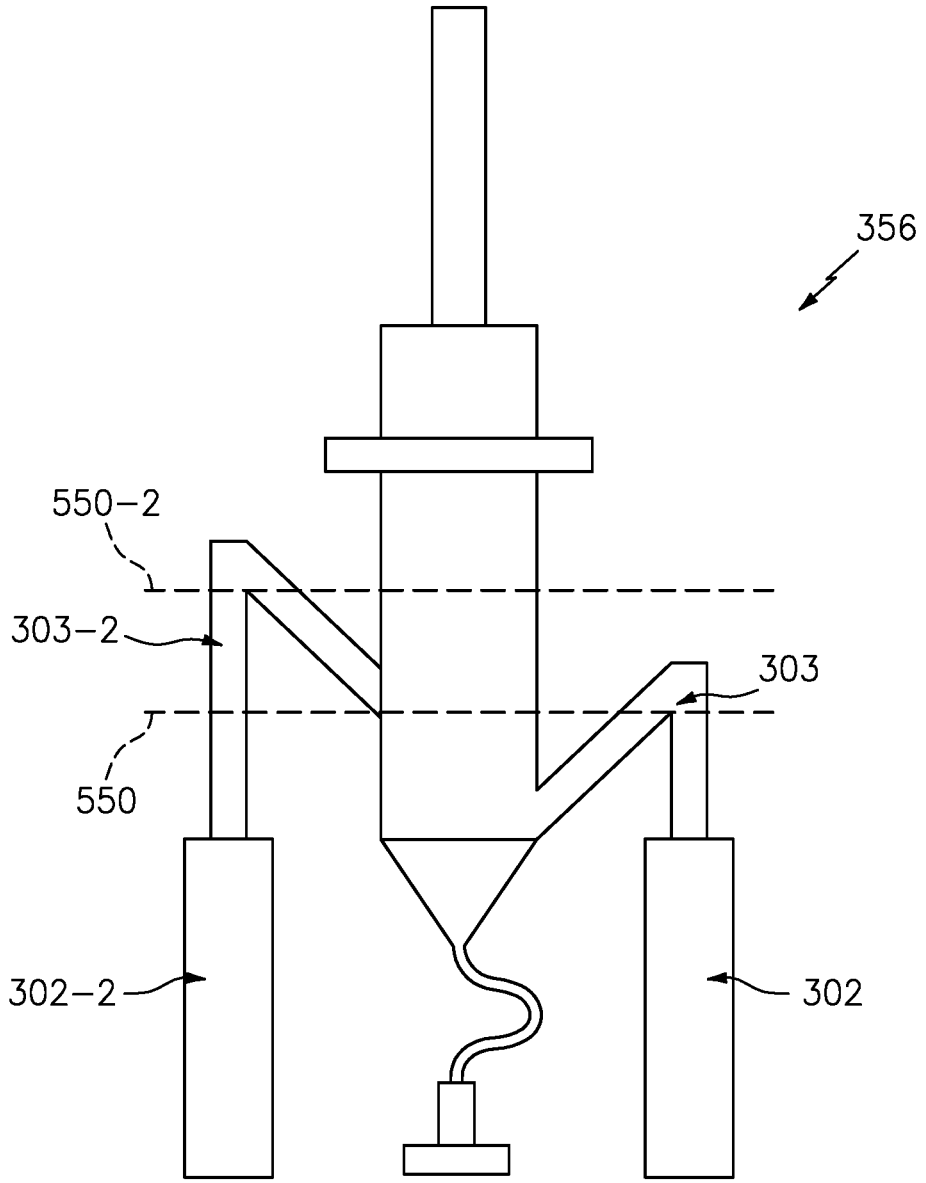
FIG. 7 is a view of a pattern for casting the blade of FIG. 3.

FIG. 7 schematically shows a shell/mold 356 a second reservoir 302-2 having a passageway 303-2 whose apex is at a level 550-2 above the level 550 but, may be otherwise similar to 303. This allows for creation of the three-zone blade with the second shot/pour overflowing into the second reservoir 302-2 in a similar fashion to how the initial shot/pour overflowed into the reservoir 302 thereby ensuring a desired height of the second pour and associated transition location 540-2 (FIG. 3) with the third shot/pour. The third pour would follow to form the remainder of the blade (i.e., a portion along the root and optionally extending at least along a proximal portion of the airfoil in this tip-downward example).

Figure 8:
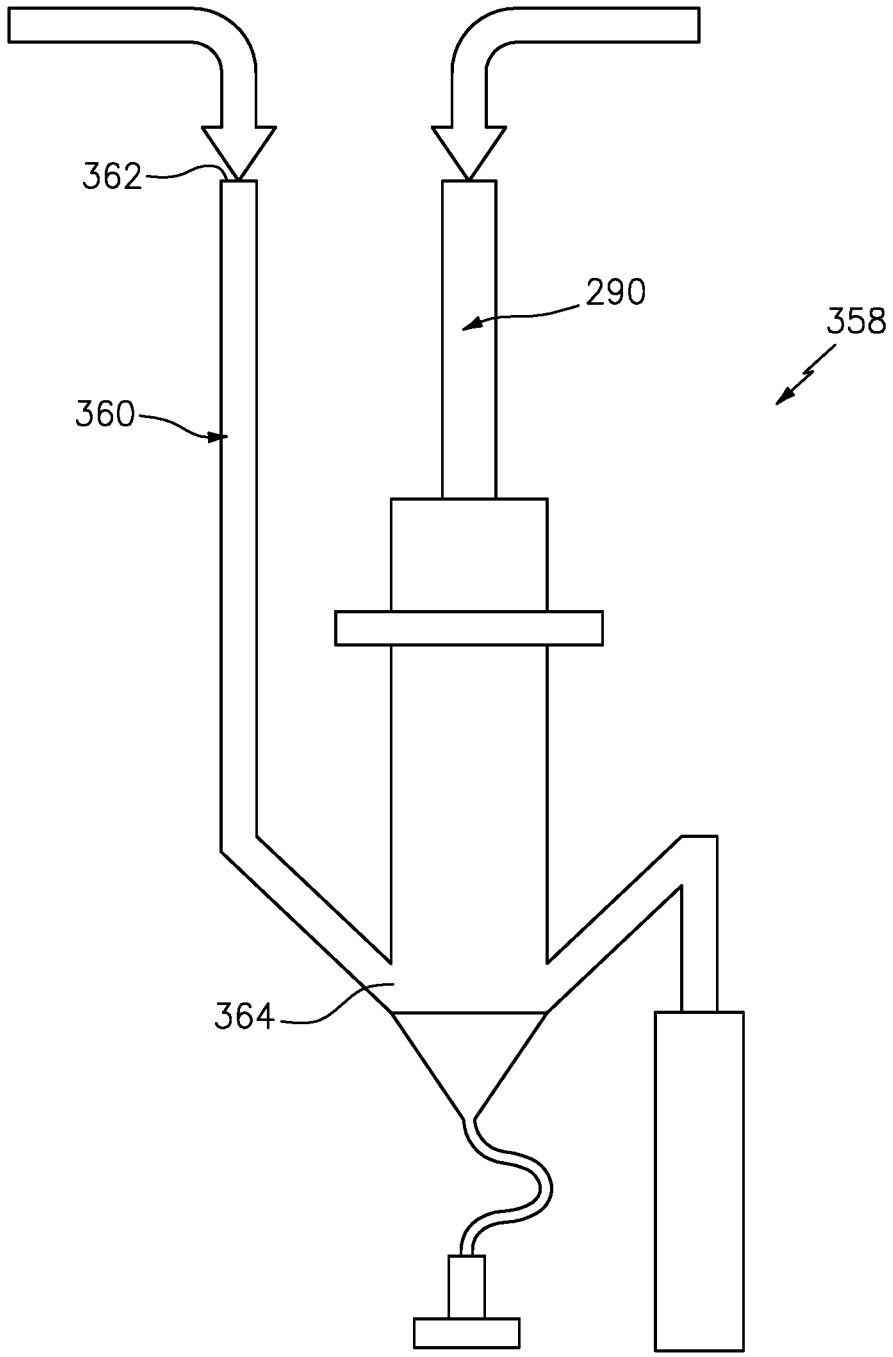
FIG. 8 is a view of an alternative pattern.

FIG. 8 schematically shows a further shell mold 358 otherwise similar to 280 with a downsprue 360 extending from an upper end/inlet 362 to a lower end at a port 364 in the part-forming cavity. The initial pour may be through the downsprue (e.g., a bottom-fill process). The second (or other subsequent) pour may proceed down the feed passageway 290 as in the earlier embodiment. This may have several advantages. For example, in some embodiments this may avoid contamination of the second pour from residue of the first pour. In other embodiments, this allows crucibles associated with the two pours to be kept more remote from each other than if the same pour cone and/or passageway were used.

Figure 9B:
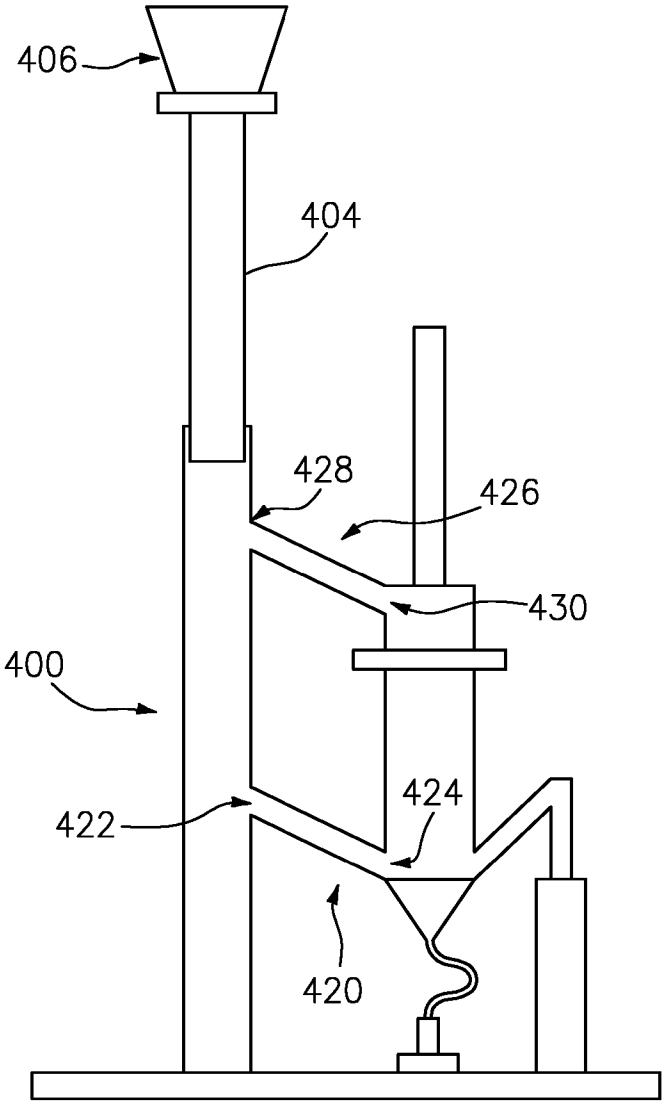
FIGS. 9A and 9B are views of a telescoping shell in respective compressed/contracted and extended conditions.
Figure 9A:
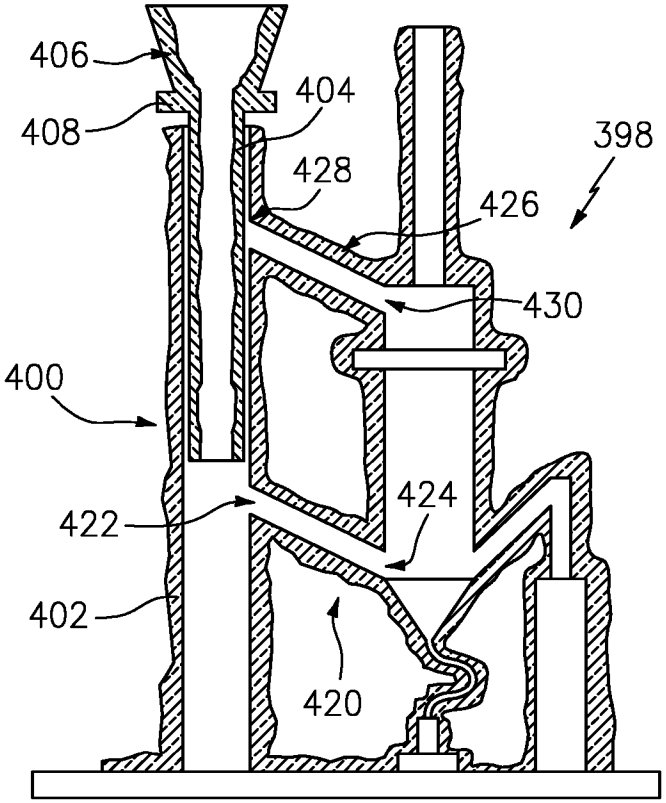

FIGS. 9A and 9B show yet another shell/mold system 398 wherein there is a telescoping downsprue 400 having a relatively larger diameter lower portion 402 and a relatively smaller diameter upper portion 404 telescopically inserted in through the upper end of the portion 402. Upper portion 404 may be formed as a single piece along with the pour cone 406 and a holding feature (e.g., a flange 408). As the mold descends through the furnace to provide the aforementioned progressive cooling, the flange 408 may be held by an upper portion of the furnace to maintain the position of the pour cone in close proximity to the crucible(s) for pouring the metal. This may minimize problems with splashing or other damage which might be associated with the pour cone retracting downward away from the crucible.

FIG. 9B more schematically shows a relatively extended condition. In the exemplary embodiment, there are two feeder branches from the downsprue for each part-forming cavity in a cluster. A lower branch 420 extends from a junction/port 422 of the downsprue to a junction/port 424 relatively low in the part-forming cavity. The upper branch 426 extends from a junction/port 428 of the downsprue to a junction/port 430 relatively high along the part-forming cavity. In the initial portion of the extension, the upper portion or member 404 blocks the port 428, but not the port 422. Only after a sufficient extension (at which point, at least a portion of the metal in the branch 420 has solidified to block that branch) is communication through the upper branch 426 opened.

Whereas the lower portion 402 may be formed by shelling the lateral outboard surface of the pattern element (e.g., in an assembled pattern cluster), the exemplary upper portion 404 may be formed by shelling an interior of a mold (whether sacrificial or not). For example, the mold may have a tubular portion and a frustoconical portion and the inner diameter (ID) of the mold may be shelled so that the resulting shell, upon removal, has a precise exterior outer diameter (OD) profile to telescopically be received in the interior of the lower portion 402.

Figure 10:
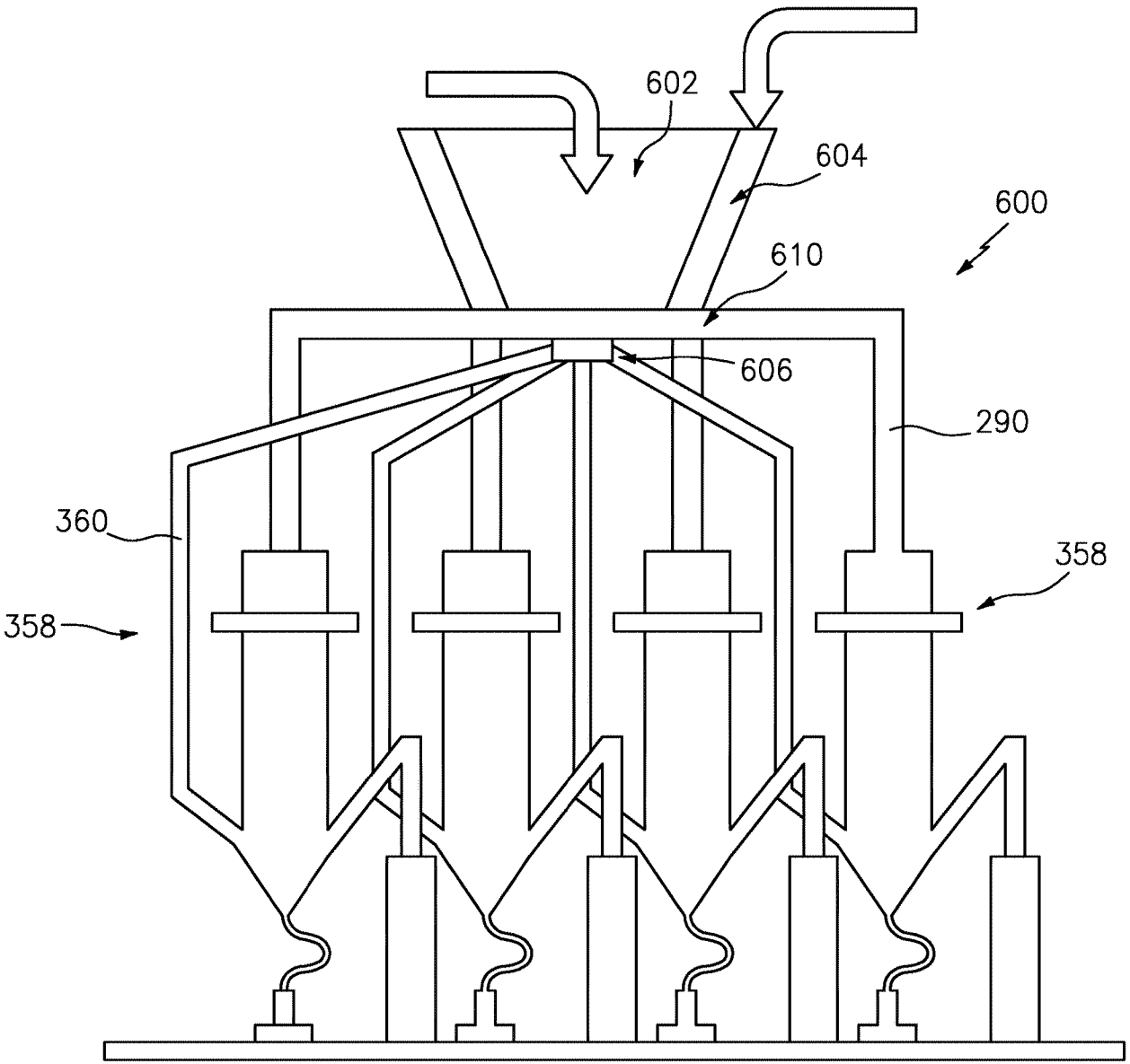
FIG. 10 is a flattened partially schematic view of passageways and chambers in a mold cluster.

FIG. 10 schematically shows an alternative mold cluster 600 with concentric inner 602 and outer 604 pour cones. The inner pour cone is coupled by an associated manifold 606 to the passageways 360 of FIG. 8, while the outer pour cone is coupled by an associated manifold 610 to feed passageways 290. A similarly structured mold cluster, wherein one of the two cones is not a pour cone but is rather used for ventilation/upflow of a single shot/pour, is found in U.S. Pat. No. 7,231,955 of Bullied et al. and entitled, "INVESTMENT CASTING MOLD DESIGN AND METHOD FOR INVESTMENT CASTING USING THE SAME" issued Jun. 19, 2007.

FIGS. 11A-11I show a sequence of stages in the use of a furnace 800. The exemplary furnace comprises two sources of two alloys. The respective sources are labeled 802-1 and 802-2. Each source comprises an ingot loader 804 (e.g., conventional type) having an ingot isolation valve 806 separating the ingot in a waiting position from the interior of a tilt induction melter 808. Each tilt induction melter has a ceramic crucible 810 with an interior for receiving and melting the associated ingot 811-1, 811-2. In the initial orientation, each crucible will have an open upper end and a closed lower end. The melter further comprises an induction coil 812 coupled to a power source (not shown) for melting the ingot. Each ingot may be deposited into the associated crucible 810 by opening the associated isolation valve 806 and loading the ingot (either manually or automatically) followed by closing the isolation valve. Each induction melter 808 includes an actuator (809) for pivoting the crucible (and coils) to pour melted material. Exemplary pivoting is about either a fixed axis 520-1, 520-2 or a moving axis.

Figure 11A:
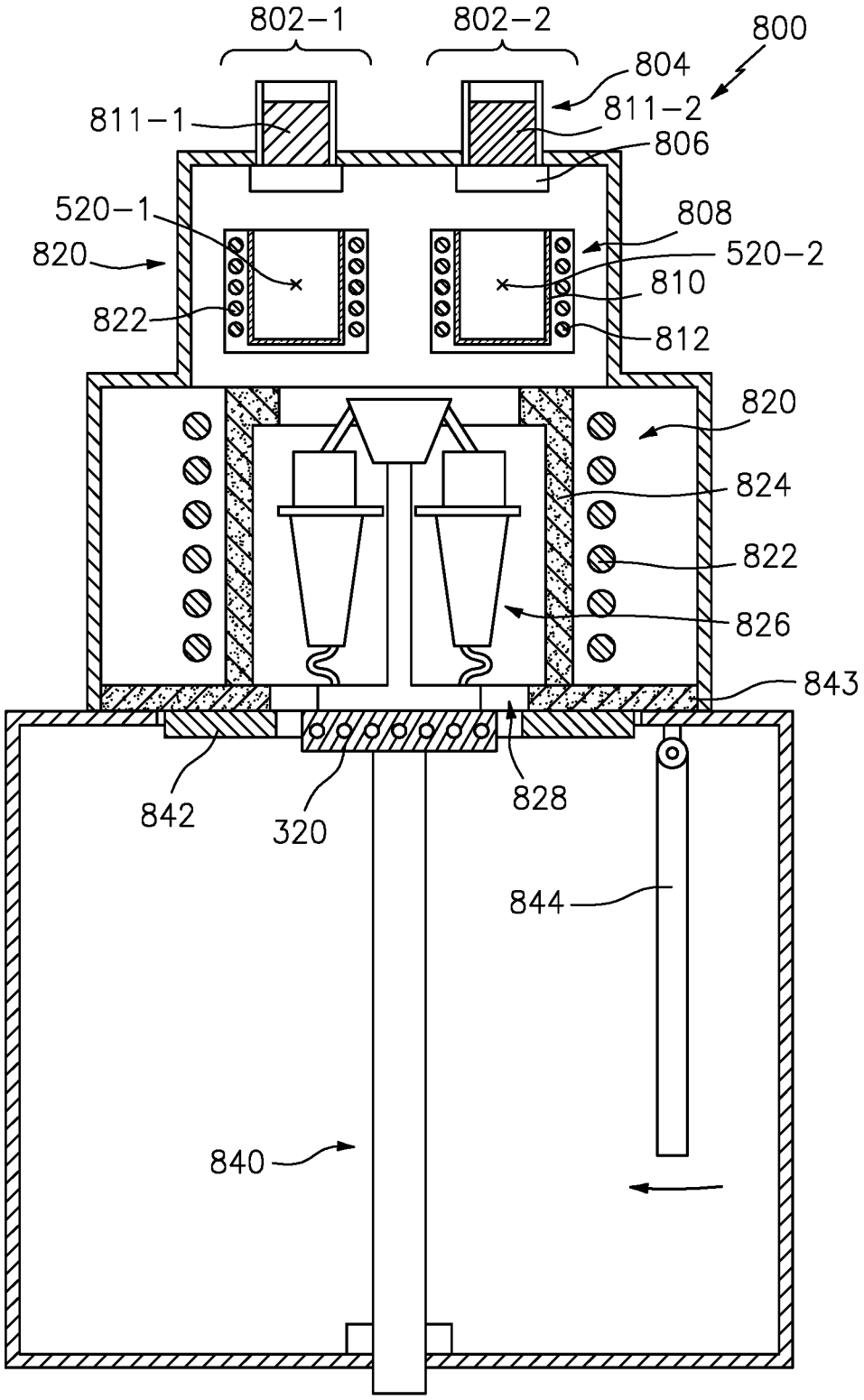
FIGS. 11A-11I are a sequence of partially schematic views of a furnace casting the blade of FIG. 2.

Below the sources, the exemplary furnace 800 includes a furnace section as an induction mold heater 820. The exemplary induction mold heater has an induction coil 822 surrounding a cylindrical graphite susceptor 824 which surrounds an internal cavity (mold chamber) 826 for receiving the associated mold. The mold may rest atop the aforementioned chill plate 320. The susceptor has an aperture in the top for allowing molten metals to be poured into the pour cone. The susceptor has an aperture 828 in the bottom allowing the mold to be progressively downwardly withdrawn. The withdrawal may be accomplished via an appropriate elevator system such as a water-cooled vertical ball screw system 840 supporting the chill plate. FIG. 11A further shows a fixed water-cooled chill ring 842 supporting the susceptor via an annular graphite baffle plate 843 and a mold chamber vacuum isolation valve 844. The valve 844 allows closing of the mold chamber when the chill plate and mold are fully retracted out of the mold chamber 826. This may allow heating of the chamber with the valve closed and may allow maintenance of the chamber temperature while a retracted mold is removed and replaced with a fresh mold (e.g., the valve thereafter being opened and the elevator used to raise the new mold). The exemplary valve 844 comprises a hinged valve element (door) hinged about an upper horizontal axis with an open position shown and a closed position rotated 90° clockwise about the axis as viewed. FIG. 11A shows the fresh mold raised up into the mold chamber with ingots in the loaders and empty induction melters.

Figure 11B:
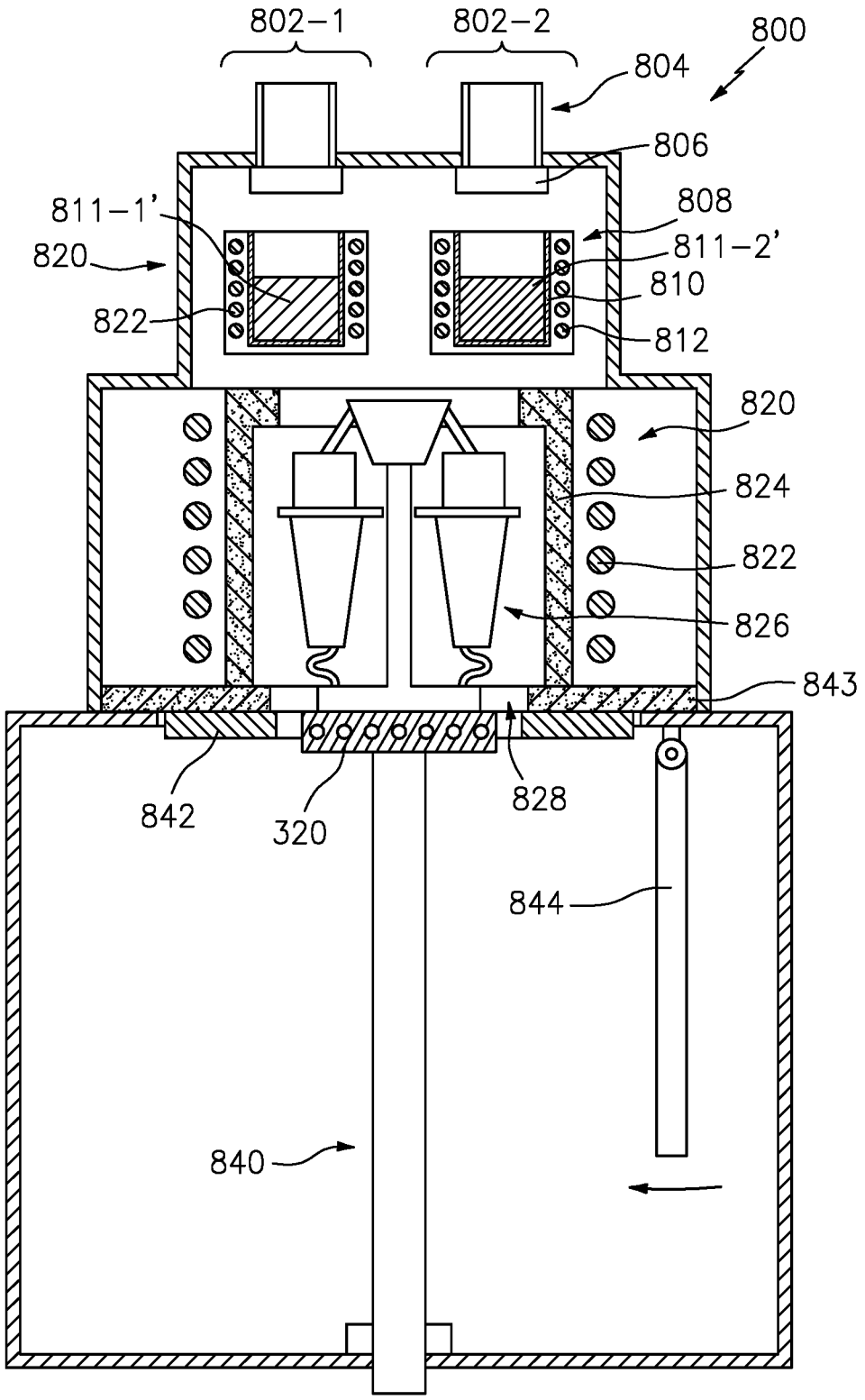

FIG. 11B shows the ingots that have been dropped into the induction melters through the isolation valves and melted to form charges 811-1' and 811-2'.

Figure 11C:
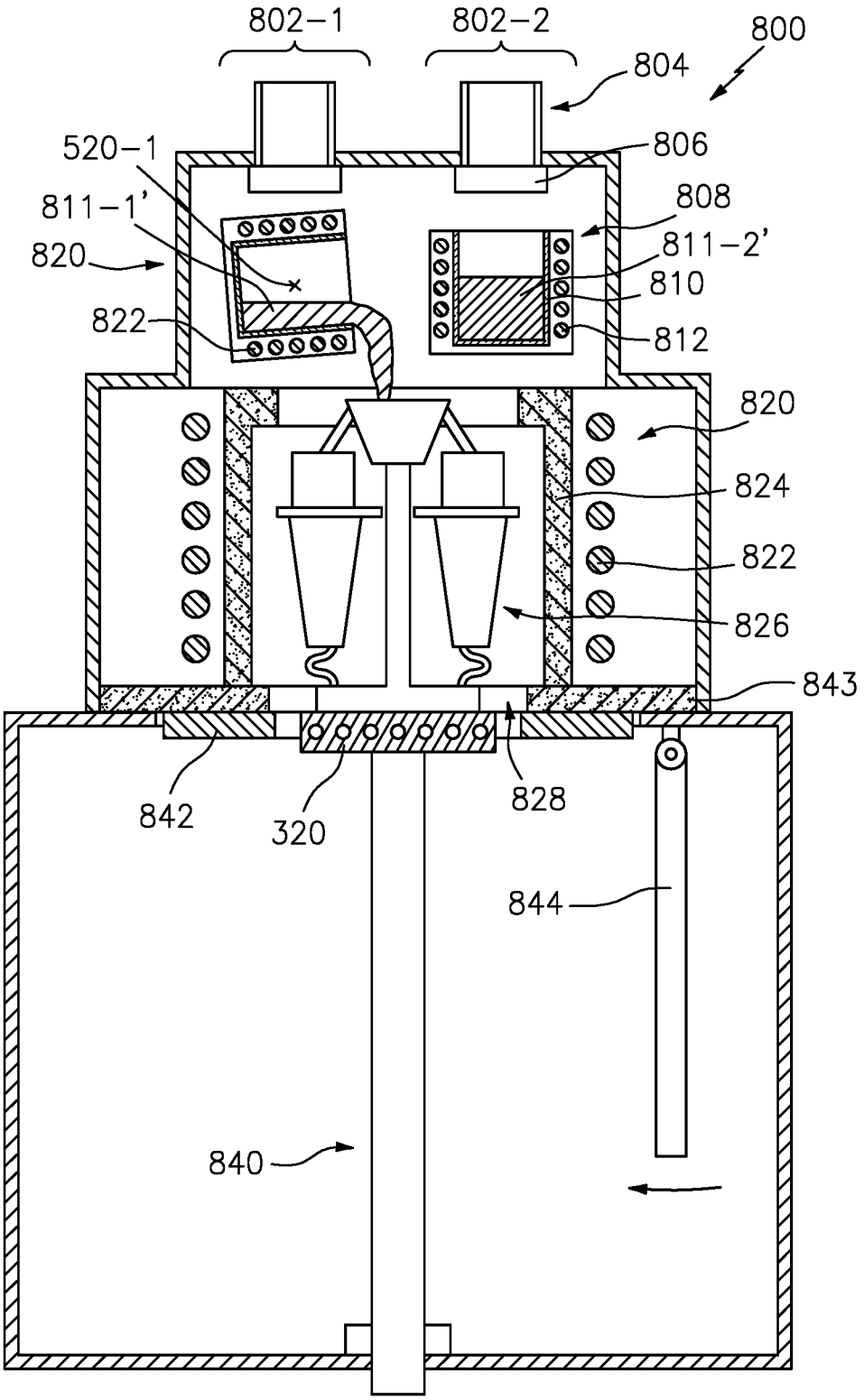

FIG. 11C shows a pouring stage from the first melter.

Figure 11D:
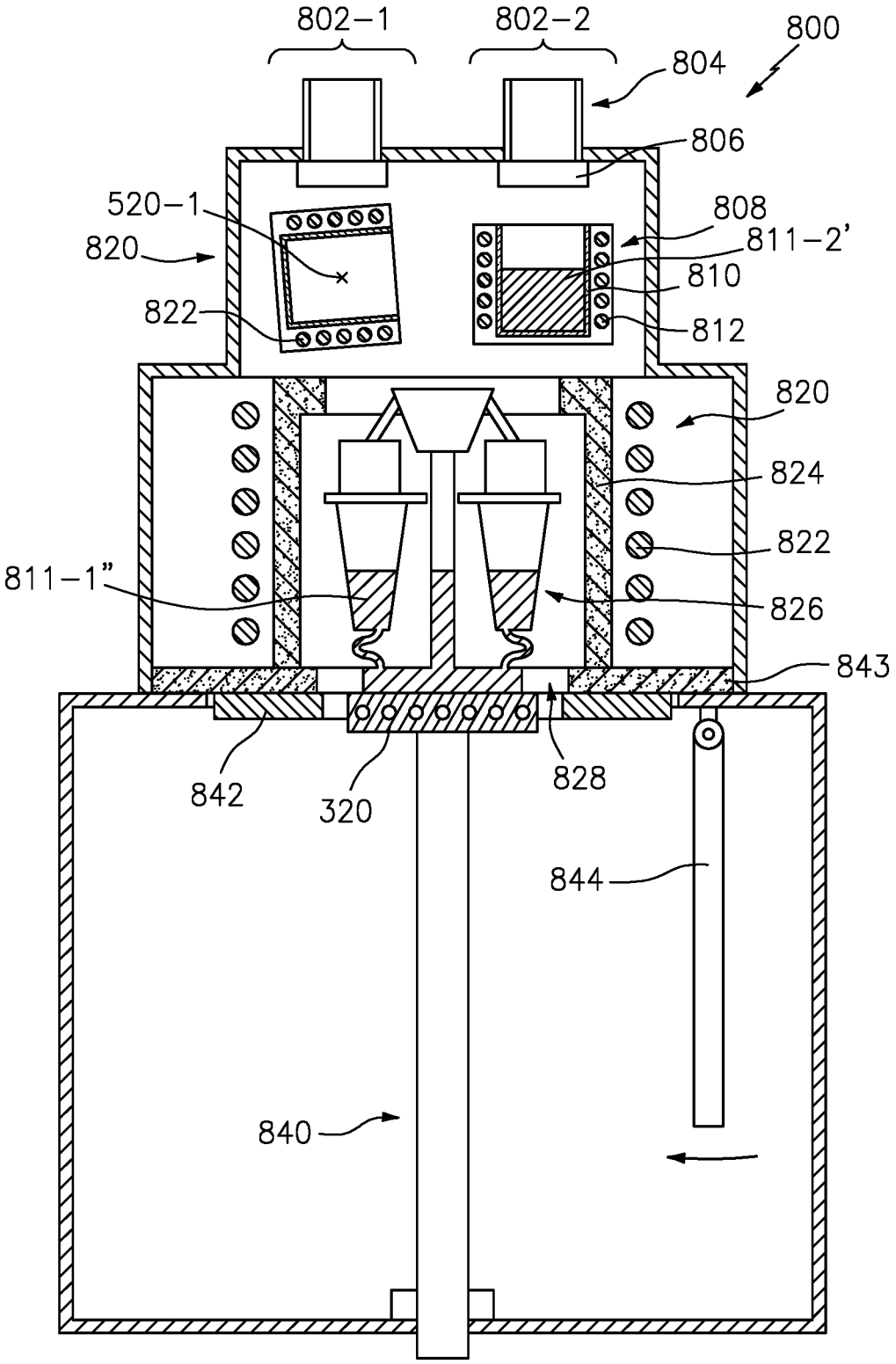
Figure 11E:
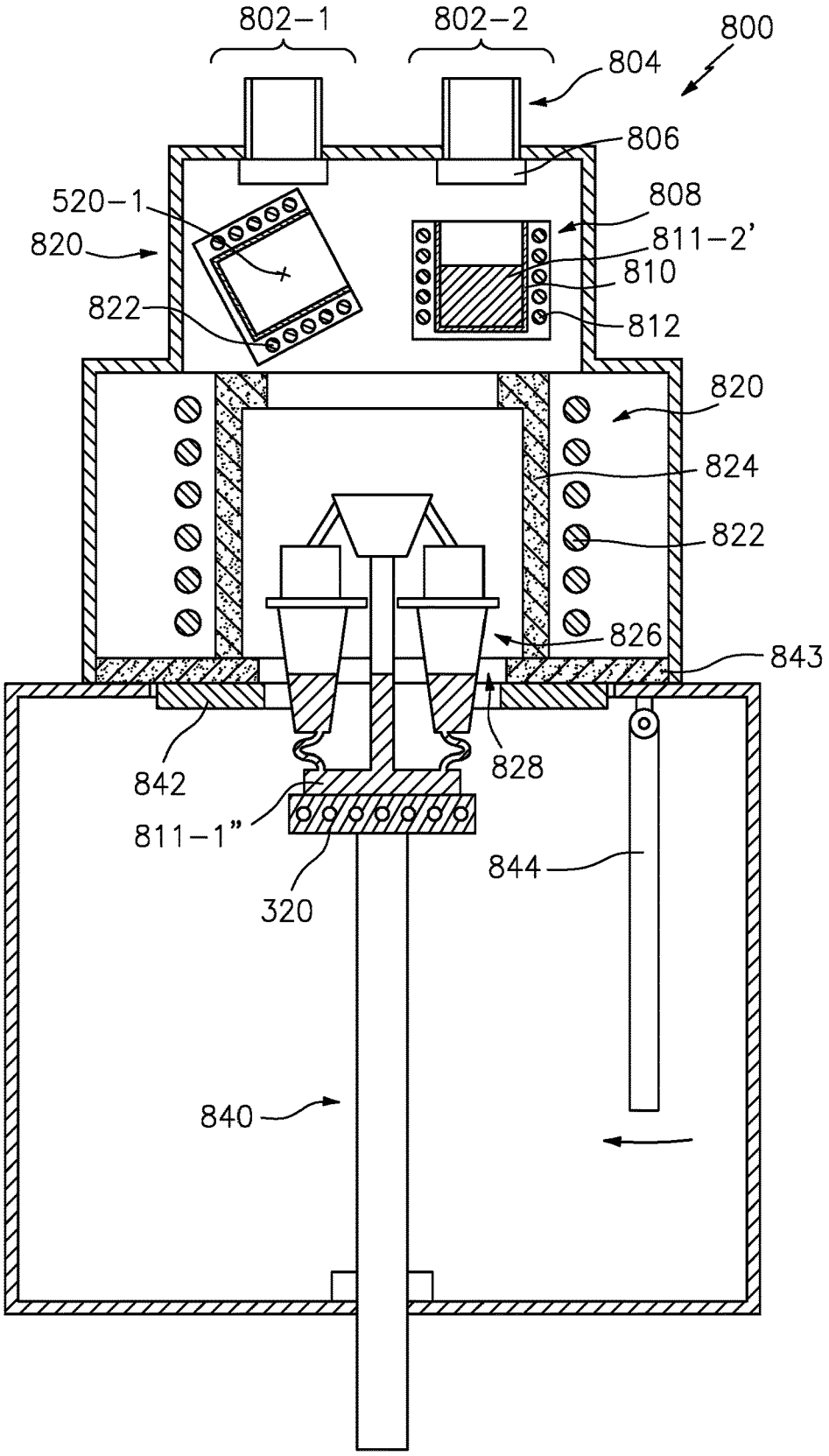

FIGS. 11D, E and F show the first melter being returned to the upright condition while the mold is retracted with first pour 811-1".

Figure 11F:
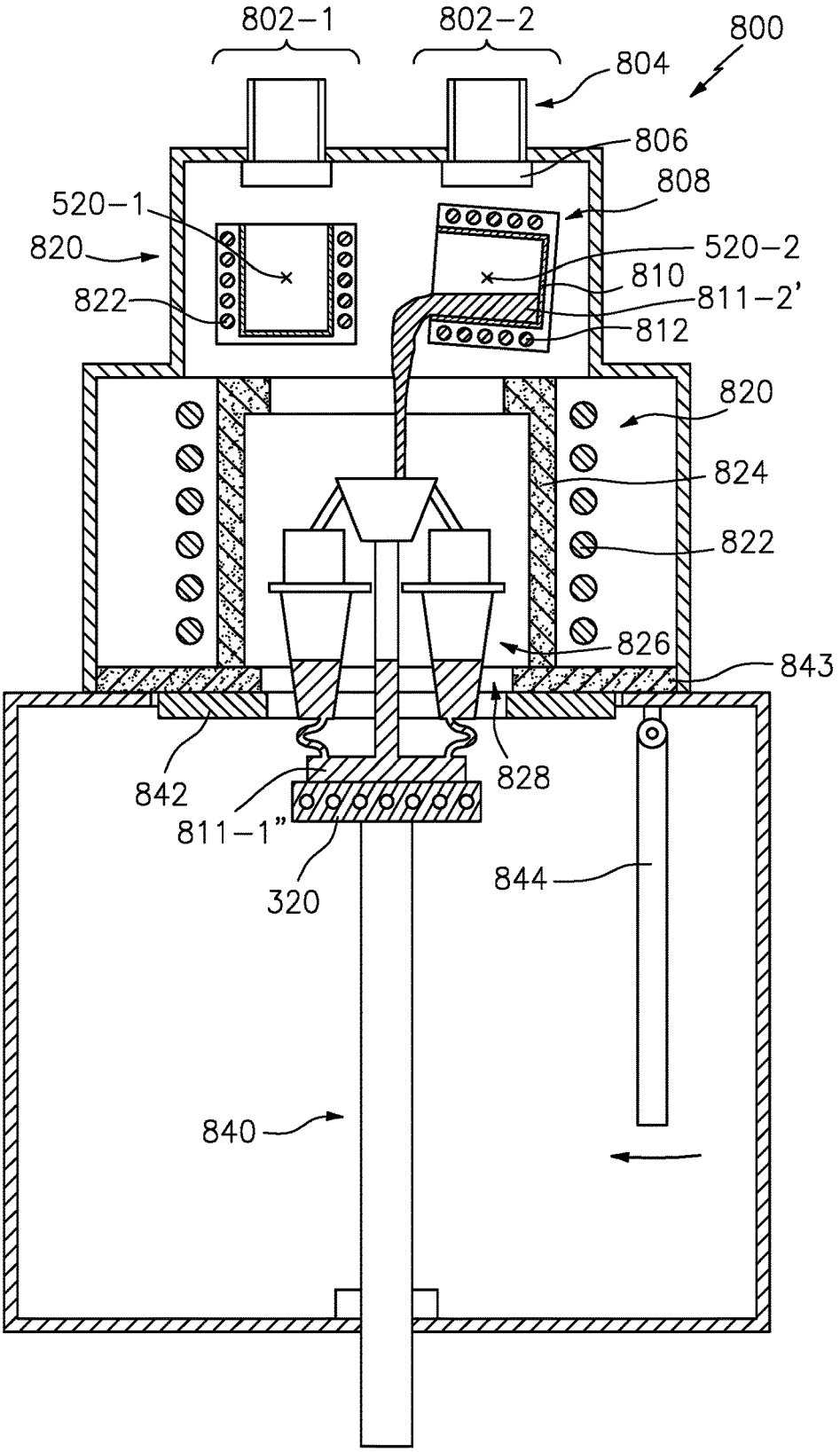

FIG. 11F shows the second melter pouring the second metal.

Figure 11G:
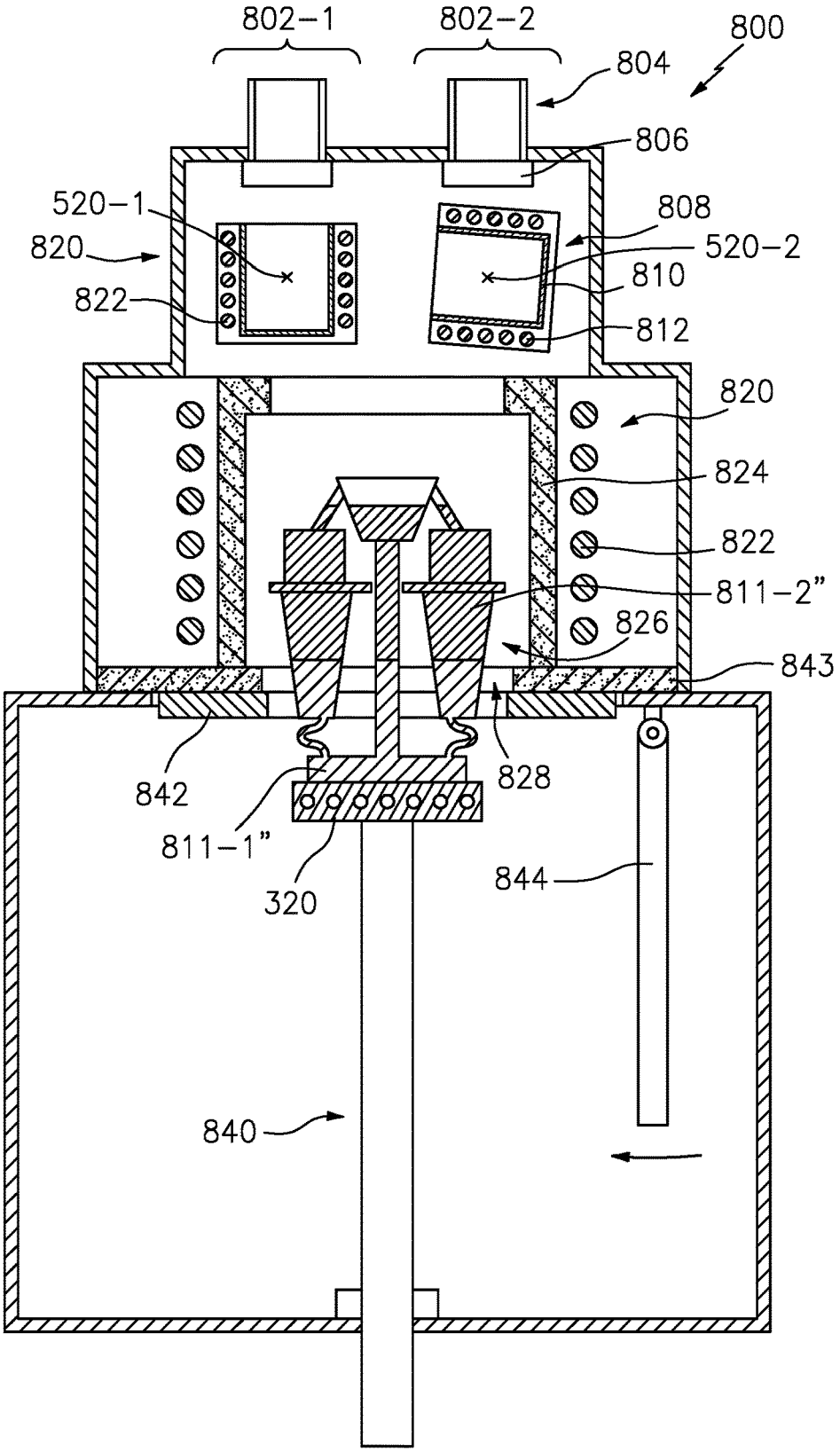
Figure 11H:
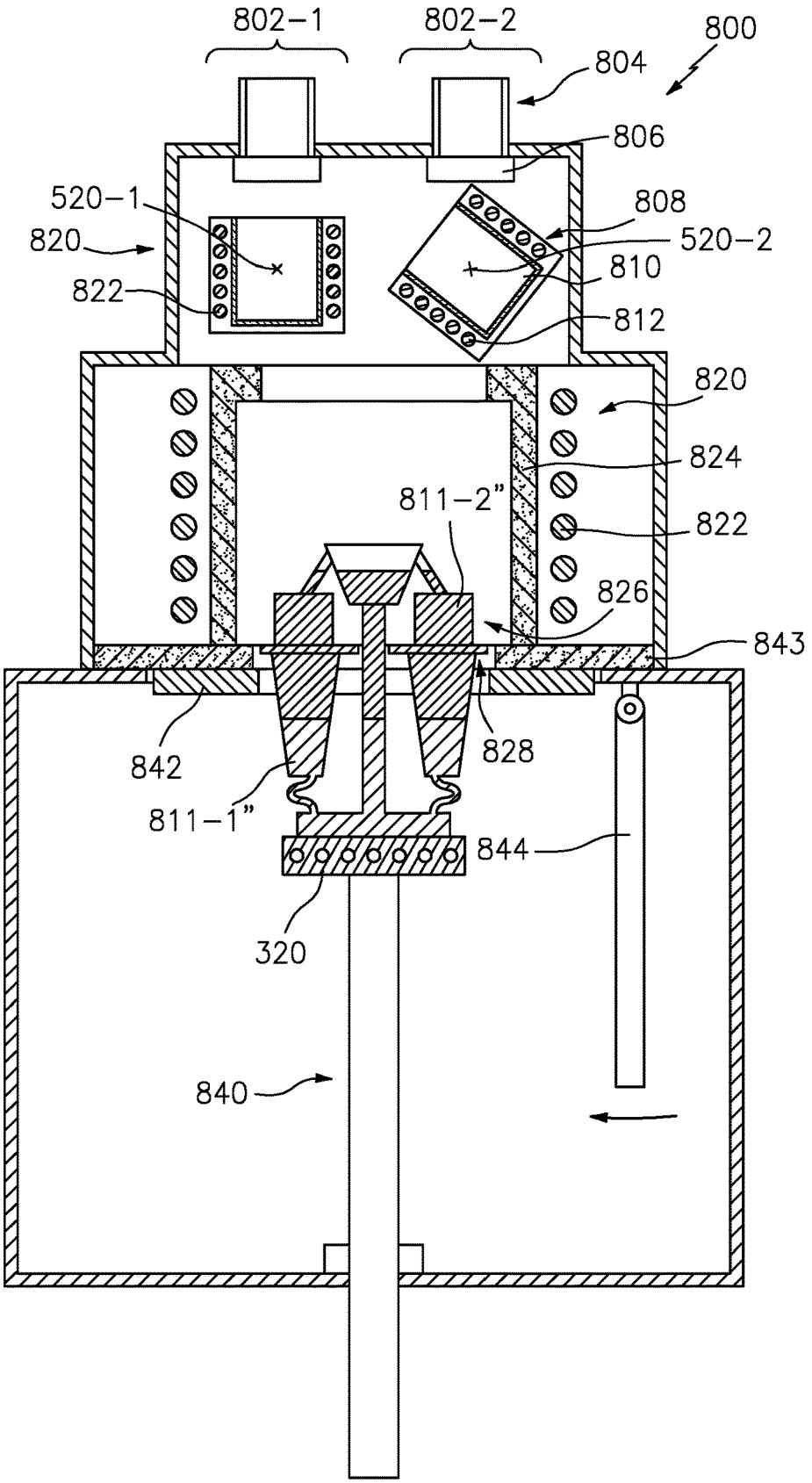
Figure 11I:
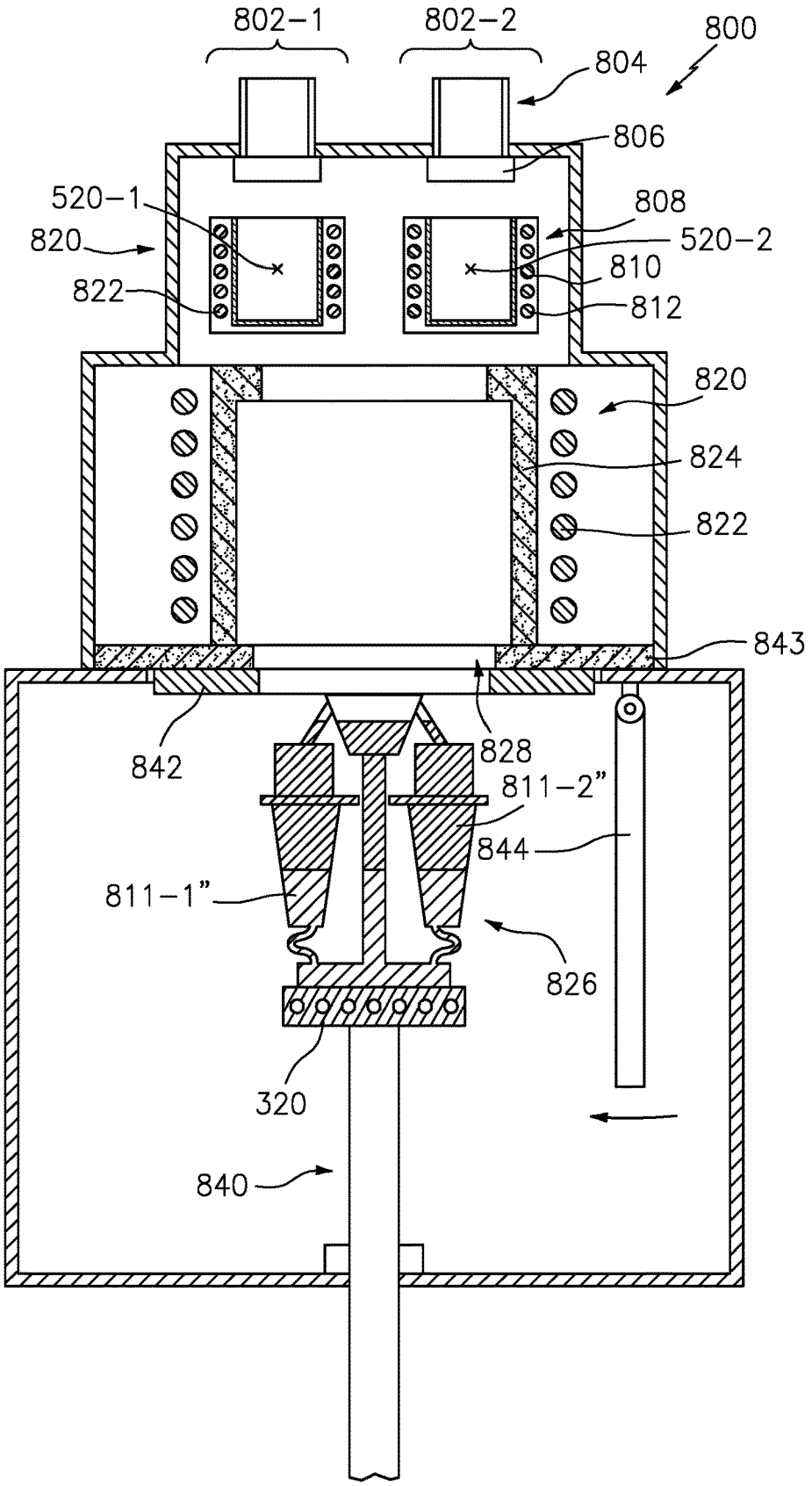

FIG. 11G-I show the second melter returning upright while the mold is further retracted with second pour 811-2".

Figure 12:
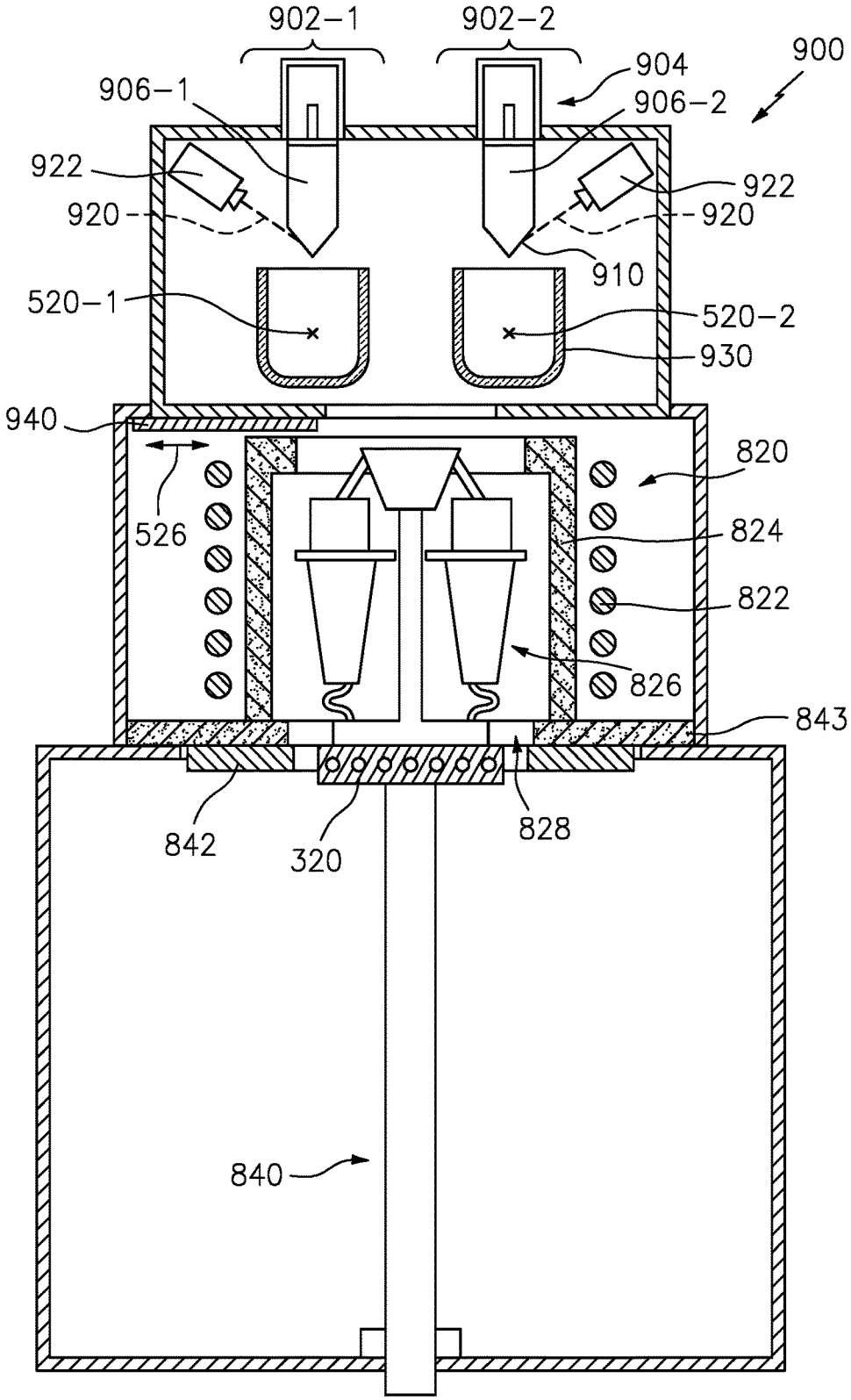
FIG. 12 is a partially schematic view of an alternate furnace.

FIG. 12 shows an alternative furnace 900 wherein the two sources 902-1, 902-2 comprise ingot feeders 904 which, rather depositing ingots 906-1, 906-2 into the crucible through valves, suspend the ingots. The ingot feeders are shown as ingot vacuum load chambers with vertical actuators for progressively lowering an ingot. The actuators maintain a lower end (tip portion) 910 of the ingot at a location accessible via an associated electron beam 920 generated by an associated electron beam gun 922 to melt the tip portion of the ingot and allow the molten material to fall into a vessel 930 such as a pivotal copper water-cooled hearth. As were the tilt melters, the hearth may be emptied by tilting by associated actuators (932). FIG. 12 further shows a sliding valve 940 (direction of motion 526) to isolate the upper chamber containing the sources from the main casting/mold chamber 826. Such a valve may be applied to any of the other apparatus. Otherwise, operational sequences may be similar to those described above.

In yet another alternative to the tilt melters of FIG. 11, alternative melters may be formed as induction skull melters (e.g., segmented copper or steel sheaths with induction coils inside).

The use of "first", "second", and the like in the following claims is for differentiation only and does not necessarily indicate relative or absolute importance or temporal order. Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to modifying a baseline part, or applied using baseline apparatus or modification thereof, details of such baseline may influence details of any particular implementation. Accordingly, other embodiments are within the scope of the following claims.

What is claimed is:

1. A casting mold comprising:
- a part-forming cavity having a lower end and an upper end;
- a pour cone; and
- a downsprue extending from the pour cone toward the part-forming cavity and comprising:
  - a lower portion having a plurality of ports in communication with the part-forming cavity; and
  - an upper portion telescoping relative to the lower portion and coupling the lower portion to the pour cone.

2. The casting mold of claim 1 wherein:
- the plurality of ports comprises an upper port and a lower port;
- the upper portion is moveable from a compressed contracted condition to an extended condition;
- in the contracted condition, the upper portion blocks the upper port; and
- movement to the extended condition unblocks the upper port.

3. The casting mold of claim 2 wherein:
- the upper portion telescopes within the lower portion.

4. The casting mold of claim 3 wherein:
- the mold along the part-forming cavity and the lower portion are formed as a single piece.

5. The casting mold of claim 1 wherein:
- the upper portion telescopes within the lower portion.

6. The casting mold of claim 1 wherein:
- the mold along the part-forming cavity and the lower portion are formed as a single piece.

7. The casting mold of claim 1 wherein:
- the part-forming cavity is one of a plurality of part-forming cavities; and
- each of the plurality of part-forming cavities coupled to the same said downsprue.

8. The casting mold of claim 1 in combination with a casting apparatus, the casting apparatus having:
- a first ingot feeder;
- a first induction melter positioned to receive an ingot from the first ingot feeder;
- a first actuator (809) for rotating the first induction melter from a charging orientation to a pouring orientation for pouring into the part-forming cavity;
- a second ingot feeder;
- a second induction melter positioned to receive an ingot from the second ingot feeder; and
- a second actuator for rotating the second induction melter from a charging orientation to a pouring orientation for pouring into the part-forming cavity.

9. A method for using the casting mold of claim 1, the method comprising:
- introducing a first molten alloy to the part-forming cavity through the pour cone and a lower port of the plurality of ports;
- extending the upper portion relative to the lower portion; and
- introducing a second molten alloy to the part-forming cavity through the pour cone and an upper port of the plurality of ports.

10. The method of claim 9 wherein:

the molten alloy introduced through the upper port is different from the molten alloy introduced through the lower port.

11. The method of claim 10 wherein:

the molten alloy introduced through the upper port is introduced after a partial solidification of the molten alloy introduced through the lower port.

12. The method of claim 9 wherein:

the molten alloy introduced through the upper port is introduced after a partial solidification of the molten alloy introduced through the lower port.

13. The method of claim 12 wherein:

the molten alloy introduced through the upper port is introduced from a second ingot and the molten alloy introduced through the lower port is introduced from a first ingot.

14. The method of claim 9 wherein:

the molten alloy introduced through the upper port is introduced from a second ingot and the molten alloy introduced through the lower port is introduced from a first ingot.

15. A method for casting with a mold having a plurality of part cavities, the method comprising:

a first pour through a first pour cone, the first pour filling a lower portion of each of the part cavities; and a second pour through a second pour cone, the first pour cone being concentric with the second pour cone, the second pour filling an upper portion of each of the part cavities.

16. The method of claim 15 wherein:

the first pour is a bottom feed and the second pour is a top feed.

* * * * *